United States Patent [19]

Inagaki et al.

[11] Patent Number: 5,075,205

[45] Date of Patent: Dec. 24, 1991

[54] SILVER HALIDE PHOTOGRAPHIC MATERIAL

[75] Inventors: Yoshio Inagaki; Keiichi Adachi; Keisuke Shiba; Yuji Mihara, all of Kanagawa, Japan

[73] Assignee: Fuji Photo Film Co., Ltd., Kanagawa, Japan

[21] Appl. No.: 711,407

[22] Filed: Jun. 5, 1991

Related U.S. Application Data

[63] Continuation of Ser. No. 457,891, Dec. 27, 1989, abandoned.

[30] Foreign Application Priority Data

Dec. 27, 1988 [JP] Japan ..... 63-329612

[51] Int. Cl.[5] ..... G03C 1/84

[52] U.S. Cl. ..... 430/522; 430/510; 430/517

[58] Field of Search ..... 552/302; 430/522, 510, 430/517

[56] References Cited

U.S. PATENT DOCUMENTS

| | | | |
|---|---|---|---|
| 2,895,826 | 7/1959 | Salminen et al. | 552/302 |
| 3,867,094 | 2/1975 | Kalopissis et al. | 552/302 |
| 3,929,403 | 12/1975 | Kalopissis et al. | 552/302 |
| 3,929,404 | 12/1975 | Kalopissis et al. | 552/302 |
| 3,977,825 | 8/1976 | Kalopissis et al. | 552/302 |
| 4,092,168 | 5/1978 | Lemahieu et al. | 432/522 |
| 4,407,747 | 2/1977 | Kalopissis et al. | 552/302 |

*Primary Examiner*—Jack P. Brammer

*Attorney, Agent, or Firm*—Sughrue, Mion, Zinn Macpeak & Seas

[57] ABSTRACT

Silver halide photographic material which has a hydrophilic colloid layer containing a solid micrograin dispersion of compounds represented by the following general formula (I):

(I)

wherein, $T^0$, $T^1$ and $T^2$ each independently represents a hydrogen atom, a halogen atom or a cyano, nitro, carboxy, alkyl, aryl, alkoxy, aryloxy, alkylthio, arylthio, alkylsulfonyl, arylsulfonyl, sulfamoyl, carbamoyl, amino, sulfonamido, carbonamido, ureido, sulfamoylamino, hydroxyl, alkenyl or acyl group, $R^3$ and $R^4$ each independently represents a hydrogen atom, a halogen atom or an alkoxy, alkyl, alkenyl, aryloxy or aryl group, $R^5$ and $R^6$ each independently represents a hydrogen atom or a group in which hydrogen atom substitution is possible, and $R^7$ and $R^8$ each independently represents an alkyl, aryl, vinyl, acyl or alkyl- or arylsulfonyl group, provided that rings may be formed by linkage of $T^1$ with $T^2$, $R^3$ with $R^5$, $R^4$ with $R^6$, $R^7$ with $R^8$, $R^5$ with $R^7$ and $R^6$ with $R^8$. The compound of formula (I) is designed to dye specific hydrophilic colloid layers in the photographic material and to decolor rapidly during development processing.

10 Claims, No Drawings

SILVER HALIDE PHOTOGRAPHIC MATERIAL

This is a continuation of Application Ser. No. 07/457,891 filed Dec. 27, 1989, now abandoned.

FIELD OF THE INVENTION

This invention relates to a silver halide photographic material which contains a dye in the form of solid micrograins.

BACKGROUND OF THE INVENTION

It is a common practice to color silver halide emulsion layers and other hydrophilic colloid layers in a silver halide photographic material in order to effect absorption of light of specific wavelengths.

The normal practice when it is necessary to control the spectral composition of light that is incident on a photographic emulsion layer is to provide a colored layer on the side that is farther from the support than the photographic emulsion layer. Such a colored layer is called a filter layer. If there is a plurality of photographic emulsion layers, filter layers may be provided between the emulsion layers.

Halation, or blurring of images, occurs due to light that has been scattered during or after passage through a photographic emulsion layer being reflected at the interface of the emulsion layer and the support or at the surface of photosensitive material on the opposite side to the emulsion layer. To prevent such halation it is known to provide a colored layer called an antihalation layer between the photographic emulsion layer and the support or on the side of the support that is opposite to the photographic emulsion layer. If there is a plurality of photographic emulsion layers, the antihalation layers may be provided between the emulsion layers.

It is also known to color a photographic emulsion layer in order to prevent a reduction of image sharpness due to scattering of light inside the layer (a phenomenon which is generally called "irradiation").

Normally, dyes are included in these hydrophilic colloid layers that are to be colored. The dyes used in this case must meet the following conditions.

(1) They must display suitable spectral absorption in correspondence to the purpose of their use.

(2) They must be inert in terms of photographic chemistry. That is, they must have no adverse effects on the performance of silver halide emulsion layers in the chemical sense, e.g., effects such as lowering of the speed, fading of latent images or fogging.

(3) Either they must be decolored or they must be eluted in processing solutions or washing water during the course of photographic processing, so that they are not responsible for harmful coloration remaining in the photographic material after processing.

(4) They must not diffuse from a dyed layer to other layers.

(5) They must have excellent stability and not be subject to discoloration or fading with the pussage of time in bath solutions or the photographic material.

In particular, in most cases where colored layers are filter layers or where they are antihalation layers provided on the same side of a support as the photographic emulsion layers, it is necessary that the layers concerned be selectively colored and there be essentially no extension of coloration to other layers. Otherwise harmful spectral effects are exerted on the other layers and the effects of the filter layer or antihalation layer may be cancelled out. However, frequently when a layer to which a dye has been added and another hydrophilic colloid layer are in contact while in a wet state, a portion of the dye diffuses from the former to the latter layer. Much past effort has been directed to preventing such diffusion of dyes.

For example, methods in which dissociated anionic dyes are introduced into layers together with hydrophilic polymers which carry an opposite charge and serve as mordants so as to localize the dyes in specific layers through interactions with dye molecules are disclosed in, e.g., U.S. Pat. Nos. 2,548,564, 4,124,386 and 3,625,694.

Further, methods for dyeing specific layers by using water-insoluble dye solids are disclosed in, e.g., JP-A-56-12639, JP-A-55-155350, JP-A-55-155351, JP-A-63-27838, JP-A-63-197943 (the term "JP-A" as used herein means an "unexamined Japanese patent application") and European Patent 15601.

Also, methods for dyeing specific layers by using metal salt micrograins on which dyes are adsorbed are disclosed in, e.g., U.S. Pat. Nos. 2,719,088, 2,496,841 and 2,496,843 and JP-A-60-45237.

However, even when these improved methods are used, there is the problem that the rate of decoloration in development processing is slow. Then, when certain conditions are altered, e.g., speeding-up of processing, improvement of processing solution compositions or improvement of photographic emulsion compositions, it is not always possible to guarantee proper performance of the decoloration functions.

There is also a demand for hydrophilic colloid layers which absorb light of, e.g., the 700 to 1000 nm region, and so can be used in a photographic material that is sensitive to near-infrared light and which contains dyes that are in the form of solid micrograin dispersions and are decolored or elute satisfactorily during development processing. But dyes suitable for this application have not been found.

SUMMARY OF THE INVENTION

Accordingly an object of the present invention is to provide photographic material which contains dyes that are in the form of solid micrograin dispersions and are so designed that they dye specific hydrophilic colloid layers in the photographic material and are rapidly decolored during development processing.

Another object of the invention is to provide silver halide photographic material which includes hydrophilic colloid layers containing dyes which absorb light of the near-infrared region and are dispersed as solid micrograins so that they are rapidly decolored during development processing.

As the result of much investigation, it has been discovered that these objects are achieved by a silver halide photographic material comprising a support having thereon a hydrophilic colloid layer containing a solid micrograin dispersion of a compound represented by the following general formula (I):

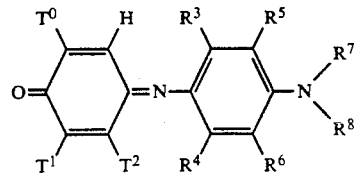

(I)

wherein, $T^0$, $T^1$ and $T^2$ each independently represents a hydrogen atom, a halogen atom or a cyano, nitro, carboxy, alkyl, aryl, alkoxy, aryloxy, alkylthio, arylthio, alkylsulfonyl, arylsulfonyl, sulfamoyl, carbamoyl, amino, sulfonamido, carbonamido, ureido, sulfamoylamino, hydroxyl, alkenyl or acyl group, $R^3$ and $R^4$ each independently represents a hydrogen atom, a halogen atom or an alkoxy, alkyl, alkenyl, aryloxy or aryl group, $R^5$ and $R^6$ each independently represents a hydrogen atom or a group in which hydrogen atom substitution is possible, and $R^7$ and $R^8$ each independently represents an alkyl, aryl, vinyl, acyl or alkyl- or arylsulfonyl groups. Rings may be formed by linkage of $T^1$ with $T^2$, $R^3$ with $R^5$, $R^4$ with $R^6$, $R^7$ with $R^8$, $R^5$ with $R^7$ or $R^6$ with $R^8$, and the groups represented by $T^0$ to $T^2$ and $R^3$ to $R^8$ may further possess substituents.

DETAILED DESCRIPTION OF THE INVENTION

In $T^0$, $T^1$ and $T^2$, the carbon number of alkyl group is 1 to 18, that of aryl group is 6 to 18, that of alkoxy group is 1 to 18, that of aryloxy group is 6 to 18, that of alkylthio group is 1 to 18, that of arylthio group is 6 to 18, that of alkylsulfonyl group is 1 to 18, that of sulfamoyl group is 0 to 18, that of carbamoyl group is 1 to 18, that of amino group is 0 to 18, that of sulfonamido group is 1 to 18, that of carbonamido group is 1 to 18, that of ureido group is 0 to 18, that of alkenyl group is 2 to 18 and that of acyl group is 1 to 18. In the sulfamoyl, carbamoyl, ureido and amino groups include a case where the hydrocarbon group is substituted.

Groups in the formula (I) that are preferred as the groups represented by $T^0$ are a group having the Hammett's o constant of greater than zero and preferred examples are a hydrogen atom, a halogen atom (F, Cl, etc.), cyano, carboxy and 1-18 C carbamoyl (e.g., carbamoyl, ethylcarbamoyl, N,N-dimethylcarbamoyl, phenylcarbamoyl, morpholin-1-ylcarbonyl), 0-18C sulfamoyl (e.g., sulfamoyl, ethylsulfamoyl, pyrrolidin-1-ylsulfonyl, phenylsulfamoyl, t-butylsulfamoyl) and acyl groups (e.g., acetyl, pivaloyl, benzoyl).

Particularly preferred groups among the groups represented by $T^0$ are groups represented by —CO—$NHG^1$ or —$SO_2NG^2G^3$ (where $G^1$ represents a substituted or unsubstituted 1-18C alkyl group, a substituted or unsubstituted 6-18C aryl group or a substituted or unsubstituted 5 or 6 membered heterocyclic group containing N, O, S, or Se as a hetero atom, $G^2$ represents a substituted or unsubstituted 1-18C alkyl group, a substituted or unsubstituted 6-18C aryl group or a substituted or unsubstituted 5 or 6 membered heterocyclic group containing N, O, S, or Se as a hetero atom and $G^3$ represents a group selected from the groups as defined for $G^2$).

Alkyl groups represented by $G^1$ and $G^2$ are, e.g., methyl, isopropyl, t-butyl, cyclohexyl, 2-ethylhexyl, 2-ethoxyethyl or 2-hydroxyethyl groups; aryl groups represented thereby are, e.g., phenyl, p-methoxyphenyl or 2-naphthyl groups; and heterocyclic groups represented by $G^1$ and $G^2$ are, e.g., thiazol-2-yl, benzothiazol-2-yl, benzoxazol-2-yl, benzoselenazol-2-yl, 1-methylbenzimidazol-2-yl, 5-methylthio-1,3,4-thia-diazol-2-yl, 5-phenyl-1,3,4-oxydiazol-2-yl, pyridin-2-yl, quinolin-2-yl or thiophen-2-yl groups.

Preferred examples of $T^1$ and $T^2$ are hydrogen atoms, F, Cl, hydroxy groups, carboxy groups, 1-18C substituted or unsubstituted alkyl groups (e.g., ethyl, t-butyl, sec-butyl, allyl-2-methoxyethyl, trifluoromethyl, cyclohexyl), 1-18C substituted or unsubstituted alkoxy groups (e.g., methoxy, isopropoxy, t-butoxy, 2-ethoxyethoxy). 6-18C substituted or unsubstituted phenoxy groups (e.g., phenoxy, 3,5-dichlorophenoxy, 2,4-di-t-amylphenoxy), 6-18C substituted or unsubstituted phenyl groups (e.g., phenyl, 4-methylphenyl, 4-t-octylphenyl, 4-methoxyphenyl), 0-18C substituted or unsubstituted amino groups (e.g., amino, acetylamino, dimethylamino, benzoylamino, methanesulfonylamino, sulfamylamino, benzensulfinylamino, ureido, phenylureido) and 2-18C substituted or unsubstituted vinyl groups (e.g., 1-propenyl, 1,2-dimethylvinyl). Preferred rings formed by linkage of $T^1$ and $T^2$ are optionally substituted benzene rings or optionally substituted 5 to 6 member hetero-rings (e.g., pyridine, pyrazine, imidazole, thiazole, 1,3-dioxole, 1,4-dioxane, furan, thiophene).

Particularly preferred for $T^1$ and $T^2$ are hydrogen atoms, Cl, 2-8C acylamino groups and atomic groups for forming benzene rings through linkage of $T^1$ and $T^2$.

Preferred for $R^3$ and $R^4$ are hydrogen atoms chlorine atoms, fluorine atoms; substituted or unsubstituted 1-18C alkoxy groups (e.g., methoxy, ethoxy, octoxy) and substituted or unsubstituted alkyl groups (e.g., methyl, isopropyl, 2-methoxyethyl, benzyl), and preferably $R^3$ and $R^4$ represent 1-5C alkyl groups.

Particularly preferred for $R^3$ and $R^4$ are hydrogen atoms, chlorine atoms, and 1-8C alkyl groups (e.g., methyl, ethyl, isopropyl, isobutyl, t-amyl, 2-ethylhexyl, cyclohexyl, t-octyl, 2-methoxyethyl, trifluoromethyl, benzyl) and 1-8C alkoxy groups (e.g., methoxy, ethoxy, sec-butoxy, t-butoxy, 2-methoxyethoxy).

The substituent represented by $R^5$ and $R^6$ which can be substituted for hydrogen atoms are, inter alia, halogen atoms (e.g., fluorine, chlorine, bromine), hydroxyl groups, cyano groups, 1-18C substituted or unsubstituted alkyl groups bonded to benzene rings directly or via bivalent linkage groups (e.g., methyl, ethyl, butyl, 2-ethylhexyl, stearyl) and 6-24C substituted or unsubstituted phenyl or naphthyl groups (e.g., phenyl, naphthyl, 3-sulfamoylphenyl, 5-methanesulfon-amido-1-naphthyl), and the bivalent linkage groups (e.g., —O—, —NHCO—, —$NHSO_2$—, —NHCOO—, —NHCONH—, —COO—, —CO—, —$SO_2$— or —NR— (where R is a hydrogen atom or a substituted or unsubstituted 1-18C alkyl group)).

Particularly preferred for $R^5$ and $R^6$ are hydrogen atoms and 1-18C alkyl groups (e.g., methyl, isobutyl, cyclohexyl, 2-ethoxypropyl).

Alkyl groups represented by $R^7$ and $R^8$ may be the same or different, and 1-18C alkyl groups (e.g., methyl, ethyl, propyl, i-butyl, n-octyl, n-dodecyl, n-octadecyl) are preferred and they may have substituents (e.g., cyano, hydroxyl, methoxy, ethoxy or similar alkoxy groups, phenoxy or similar aryloxy groups, acetamido, methanesulfonamido or similar amido groups and chlorine, fluorine or similar halogen atoms).

Aryl (6-18C) groups represented by $R^7$ and $R^8$ may be the same or different and are preferably substituted or unsubstituted phenyl groups {for example, substituted with substituents such as hydroxyl groups, cyano groups, halogen atoms (e.g., chlorine, fluorine), 2-18C acyl groups (e.g., acetyl, propionyl, stearoyl), 1-18C sulfonyl groups (e.g., methanesulfonyl, ethanesulfonyl, octanesulfonyl), 1-18C carbamoyl groups (e.g., unsubstituted carbamoyl, methylcarbamoyl, octylcarbamoyl), 1-18C sulfamoyl groups (e.g., unsubstituted sulfamoyl, methylsulfamoyl, butylsulfamoyl), 2-18C alkoxycarbonyl groups (e.g., methoxycarbonyl, trichloroethoxycarbonyl, decyloxycarbonyl), 1-18C alkoxy groups (e.g., methoxy, butoxy, pentadecyloxy), amino groups (e.g,, dimethylamino, diethylamino, dihexylamino)} and substituted or unsubstituted naphthyl groups (the same groups as for the phenyl groups being preferred as substituents).

Preferred vinyl groups represented by $R^7$ and $R^8$, which may be the same or different, are 2-18C substituted or unsubstituted vinyl groups (e.g., vinyl, 1-propenyl, 2,2-dimethylvinyl, 1-methyl-1-propenyl).

Preferred acyl groups represented by $R^7$ and $R^8$, which may be same or different, are substituted or unsubstituted 1-18C aliphatic or aromatic acyl groups (e.g., acetyl, pivaloyl, benzoyl, 4-carboxybenzoyl).

Preferred alkyl- or arylsulfonyl groups represented by $R^7$ and $R^8$, which may be the same or different, are optionally substituted 1-18C alkyl- or arylsulfonyl groups (e.g., methanesulfonyl, octanesulfonyl, benzenesulfonyl, 3-carboxybensenesulfonyl, trifluoromethanesulfonyl, hydroxymethanesulfonyl).

Five and six member rings are preferred as rings formed by linkage of $R^3$ and $R^5$ or $R^4$ and $R^6$ and particularly preferred rings are aromatic rings such as benzene rings and hetero-aromatic rings such as pyridine, imidazole, thiazole and pyrimidine rings.

Five and six member rings are preferred as rings formed by linkage of $R^5$ and $R^7$or $R^6$ and $R^8$.

For rings formed by linkage of $R^7$and $R^8$, 5 or 6 member rings are preferred and pyrrolidine, piperidine and morpholine rings are particularly preferred.

In all cases, groups such as sulfonic acid groups, etc. which have a pKa (acid dissociation constant) of 2 or less are unsuitable and groups with a pKa of 3 or more are preferred as the substituents in compounds represented by general formula (I). In order to facilitate removal from the sensitive material at the time of development, it is preferable that the compounds have 1 to 4 groups with a pKa of 3 to 12, groups with a pKa of 4 to 11 being particularly preferred. Examples of such groups include carboxyl, phenolic hydroxyl, $—NHSO_2$ and active methylene groups such as $—COCH_2CO—$. Particularly preferred groups of these groups are groups which are not directly linked to aromatic rings.

Among the compounds represented by general formula (I), compounds represented by the following formulas (Ia) and (Ib) are preferable in that they are suitable for absorption of light of a wavelength of 700 nm or more;

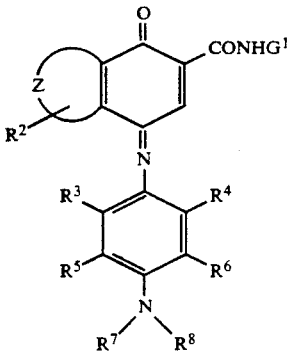

(Ia)

-continued

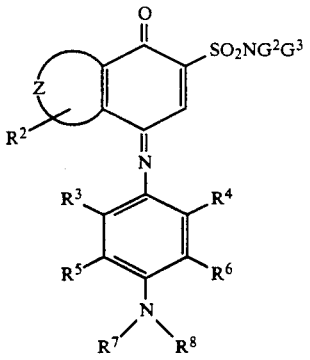

(Ib)

In the above formulas, $G^1$, $G^2$, $G^3$, $R^3$, $R^4$, $R^5$, $R^6$, $R^7$ and $R^8$ are defined as above, Z represents a benzene ring or an atomic group needed for forming a 5 or 6 member hetero-ring, and $R^2$ represents a group selected from the groups as defined for $R^5$ and $R^6$.

Substituted or unsubstituted hetero-rings represented by $G^1$ are monocyclic or condensed heterorings and preferably are condensed heterocyclic aromatic rings. Preferred hetero atoms forming hetero-rings represented by $G^1$ are B, N, O, S, P, Se and Te. Hetero-rings represented by $G^1$ are preferably 5 or 6 member rings and preferably they are rings capable of bonding with CONH— groups on carbon atoms located in positions adjacent the hetero atoms.

Particularly preferred rings of the hetero-ring groups represented by $G^1$ are 1,3-thiazole, 1,3,4-triazole, benzothiazole, tetrazole, benzimidazole, benzoxazole, 1,3,4-thiadiazole, 1,3,4-oxadiazole, imidazole, indole, benzoselenazole, pyridine, pyrimidine, 1,3,5-triazine and quinoline rings.

Preferred substituents on the hetero-rings represented by $G^1$ are substituted or unsubstituted 1-18C alkyl groups, substituted or unsubstituted 1-18C alkylthio groups, substituted or unsubstituted 6-18C aryloxy groups, substituted or unsubstituted 6-18C arylthio groups, mercapto groups, hydroxyl groups, substituted or unsubstituted amino groups (with examples being substituents such as 1-18C alkyl, 6-18C aryl, 1-18C acyl, 1-18C alkylsulfonyl and 6-18C arylsulfonyl groups), carboxyl groups, 1-18C alkyl- or 6-18C arylsulfonyl groups, substituted or unsubstituted 0-18C ureido groups, substituted or unsubstituted 0-18C carbamoyl groups, 0-18C sulfamoyl groups, halogen atoms (preferably F or Cl), nitro groups and cyano groups.

Compounds represented by formula (Ia) and (Ib) may form dimers via one or another of $G^1$, $G^2$, $G^3$, $R^3$, $R^4$, $R^5$, $R^6$, $R^7$ and $R^8$.

$G^3$ preferably is a hydrogen atom or is selected from groups with the same definitions given below for preferred $G^2$ groups.

Alkyl groups represented by $G^2$ may be the same or different and are preferably 1-18C alkyl groups (e.g., methyl, ethyl, propyl, i-butyl, n-octyl, n-decyl, n-octadecyl) and they may have substituents (e.g., cyano, hydroxyl, methoxy, ethoxy and similar alkoxy groups, phenoxy and similar aryloxy groups, acetamido, methanesulfonamido and similar amido groups and halogen atoms such as chlorine or fluorine atoms).

Aryl groups represented by $G^2$ may be the same or different and are preferably substituted or unsubstituted phenyl groups {suitable substituents, e.g., being hydroxyl groups, cyano groups, halogen atoms (e.g., chlorine, fluorine), 2-18C acyl groups (e.g., acetyl, propionyl, stearoyl), 1-18C sulfonyl groups (e.g., methanesulfonyl, ethanesulfonyl, octanesulfonyl}, 1-18C carbamoyl groups (e.g., unsubstituted carbamoyl, methylcarbamoyl, octylcarbamoyl), 1-18C sulfamoyl groups (e.g., unsubstituted sulfamoyl, methylsulfamoyl, butylsulfamoyl), 2-18C alkoxycarbonyl groups (e.g., methoxycarbonyl, trichloroethoxycarbonyl, decyloxycarbonyl), 1-18C alkoxy groups (e.g., methoxy, butoxy, pentadecyloxy), amino groups (e.g., dimethylamino, diethylamino, dihexylamino) and substituted or unsubstituted naphthyl groups (the same groups as noted for phenyl groups being preferred as substituents).

The substituted or unsubstituted hetero-ring represented by $G^2$ are monocyclic hetero-rings or condensed hetero-rings, examples of preferred rings being 1,3-thiazole, 1,3,4-triazole, benzothiazole, benzimidazole, benzoxazole and 1,3,4-thiadiazole rings (with substituents, being e.g., groups such as methyl, ethyl, octyl and similar alkyl groups, methoxy, ethoxy, decyl oxy and similar alkoxy groups and hydroxyl groups.)

Five and six member rings are preferred as rings that are formed by linkage of $R^3$ and $R^5$ or $R^4$ and $R^6$, and aromatic rings such as benzene rings and heteroaromatic rings such as pyridine, imidazole, thiazole and pyrimidine rings are particularly preferred.

Five and six member rings are preferred as rings that are formed by linkage of $R^5$ and $R^7$ or $R^6$ and $R^8$.

Five and six member rings are preferred as rings that are formed by linkage of $R^7$and $R^8$, and pyrrolidine, piperidine and morpholine rings are particularly preferred.

The hydrogen atoms of the $R^2$ groups may be replaced by halogen atoms (e.g., fluorine, chlorine, or bromine), hydroxyl groups, cyano groups, substituted or unsubstituted 1-18C alkyl groups bonded to benzene rings directly or via bivalent linkage groups (e.g., methyl, ethyl, butyl, 2-ethylhexyl, stearyl) and 6-24C substituted or unsubstituted phenyl or naphthyl groups (e.g., phenyl, naphthyl, 3-sulfamoylphenyl, 5-methanesulfonamido-1-naphthyl). Bivalent linkage groups are, e.g., —O—, —NHCO—, —$NHSO_2$—, —NHCOO—, —NHCONH—, —COO—, —CO—, —$SO_2$— and —NR— (where R is a hydrogen atom or a substituted or unsubstituted 1-18C alkyl group).

Still more preferably, $G^2$ represents heterocyclic groups or represents phenyl groups substituted by groups with a Hammett substituent constant $\delta_m$ or $\delta_p$ of greater than 0.23. Preferred univalent groups with a Hammett substituent constant $\delta_m$ or $\delta_p$ greater than 0.23 as substituent include halogen atoms (e.g., fluorine, chlorine, or bromine), cyano groups, formyl groups, carboxy groups, carbamoyl groups (e.g., unsubstituted carbamoyl, methylcarbamoyl), alkoxycarbonyl groups (e.g., methoxycarbonyl, ethoxycarbonyl), acyl groups (e.g., acetyl, benzoyl), nitro groups, sulfamoyl groups (e.g., unsubstituted sulfamoyl, methylsulfamoyl) and sulfonyl groups (e .g ., methanesulfonyl, benzenesulfonyl,). $\delta_m$ and $\delta_p$ values are noted in "*Yakubutsu no Kozo Kassei Sokan*" ("*Activity Correlations of Pharmaceutical Structures*"), p. 96 (published by Nankodo) (1979), and substituents may be selected by referring to this table.

Hydrogen atoms are particularly preferred for $G^3$.

Particularly preferred groups for $R^2$ are 1-18C alkyl- or 6-18C arylsulfonamido groups, 1-18C acylamino groups, 1-18C alkyl- or 6-18C aryl-substituted ureido groups, 1-18C alkoxy- or 6-18C aryloxycarbonylamino groups, fluorine atoms and chlorine atoms and the preferred substitution position is the 5 position.

The rings completed by Z are benzene rings or 5 or 6 member hetero-rings, and nitrogen, oxygen, sulfur and selenium atoms may be cited as preferred hetero atoms. Benzene and pyridine rings are particularly preferred and benzene rings are the most preferred. Preferred hetero rings other than pyridine rings that may be cited include pyrimidine, triazole, imidazole, thiazole, selenazole and oxazole rings.

Specific examples of compounds that are represented by general formula (I) and which can be employed in the invention are set forth below, although the scope of the invention is not limited to these examples.

1. 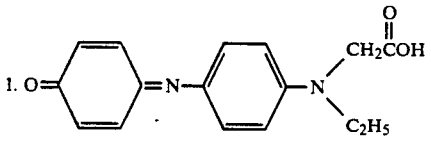

2. 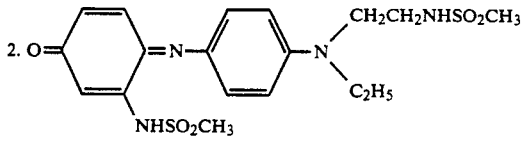

3. 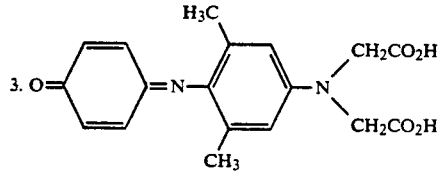

4. 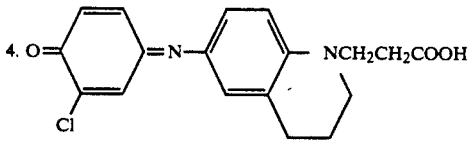

5. 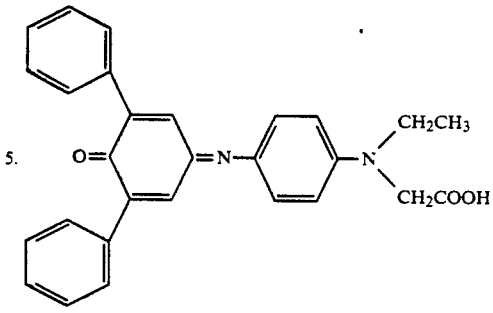

6. 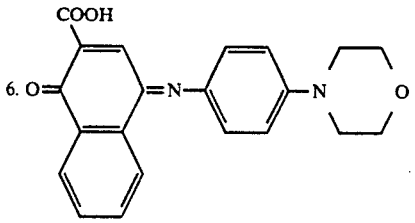

-continued
7.
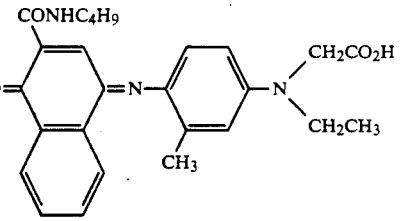
8.
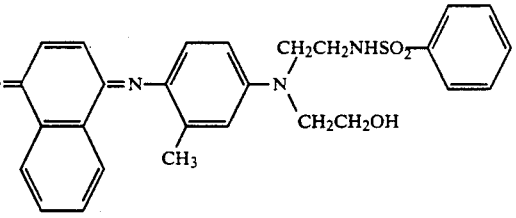
9.
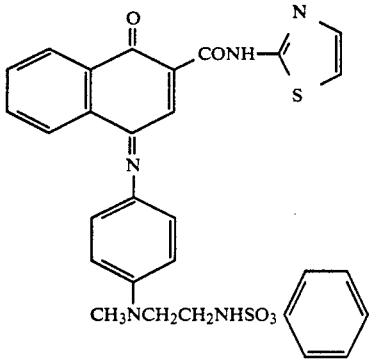
10.
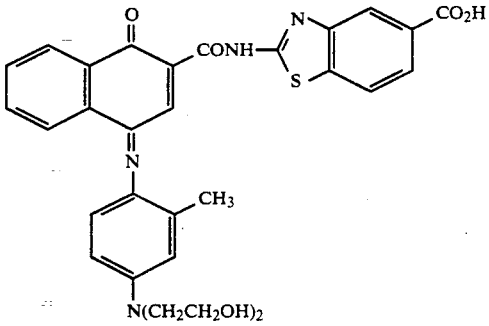
11.
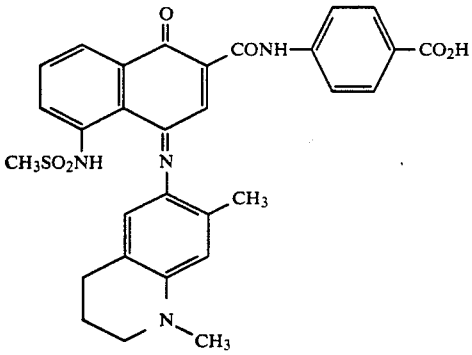
12.
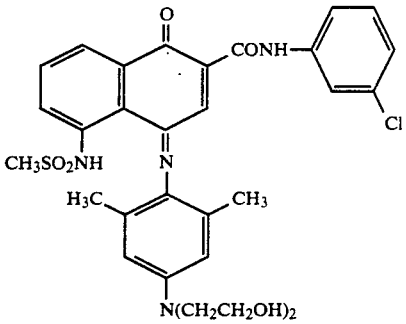
13.
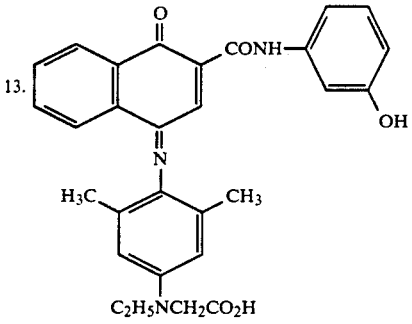
14.
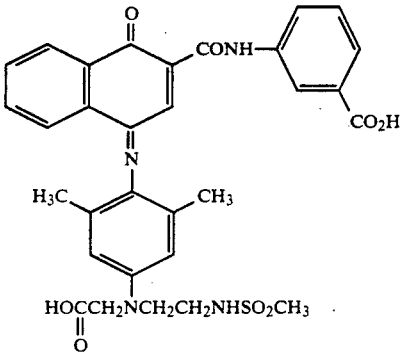

-continued
15.
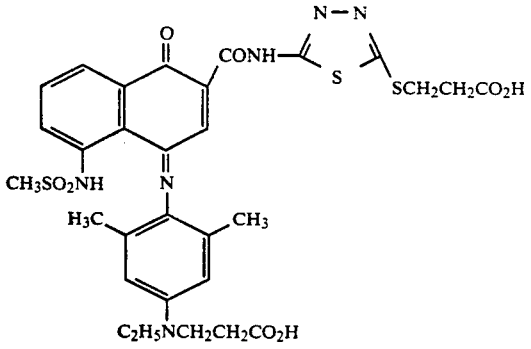
16.
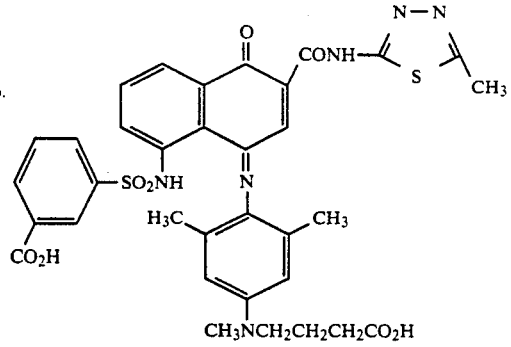
17.
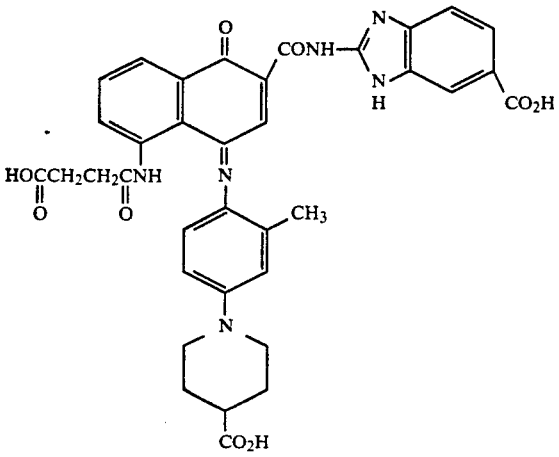
18.
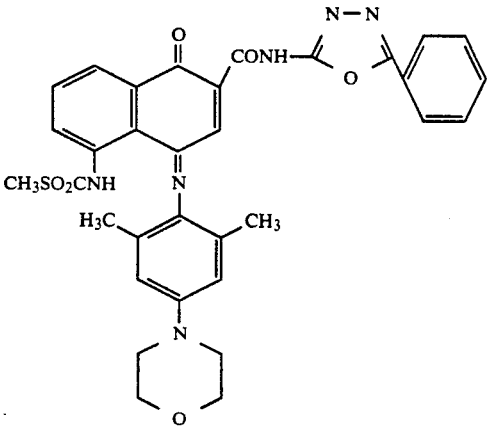
19.
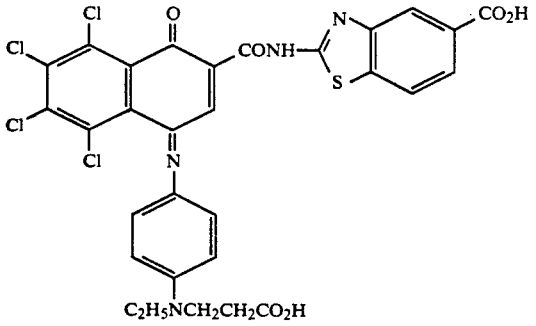
20.
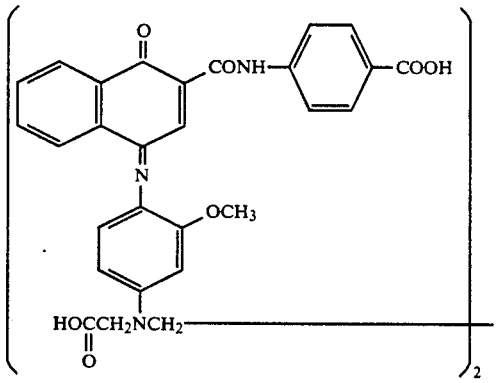
21.
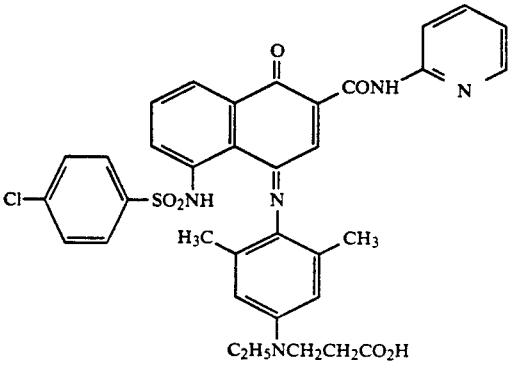
22.
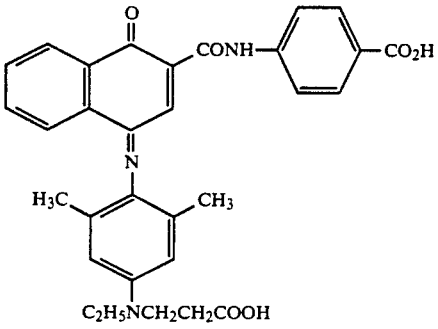

-continued
23.
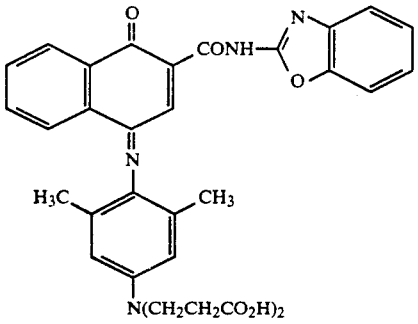
24.
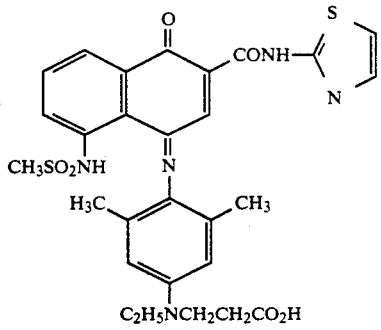
25.
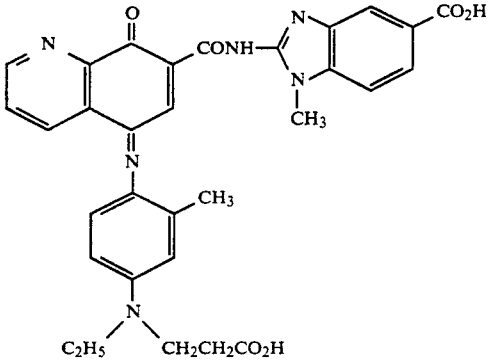
26.
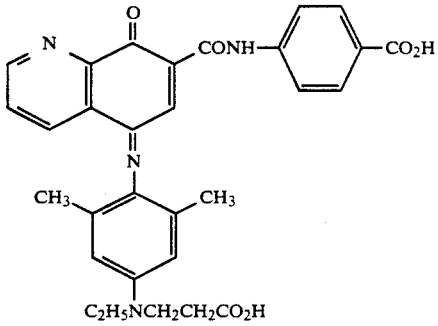
27.
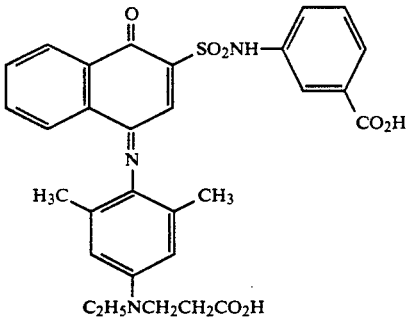
28.
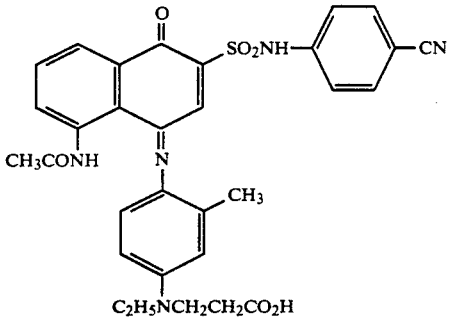
29.
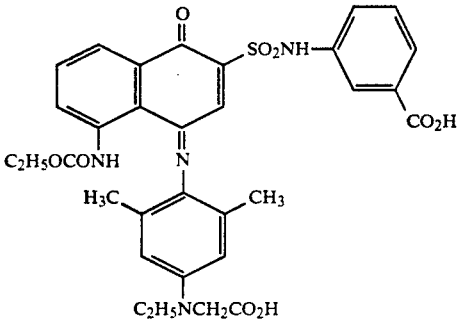
30.
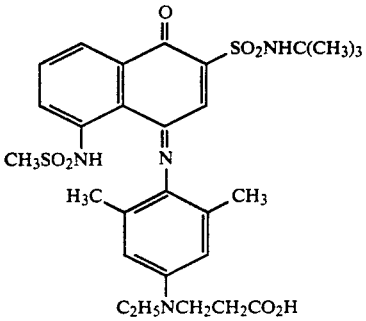

-continued
31.
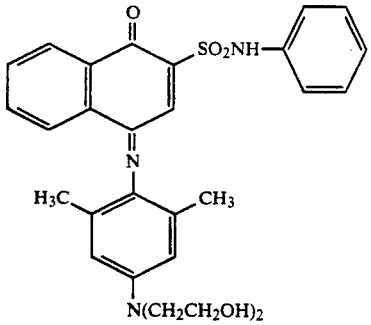
32.
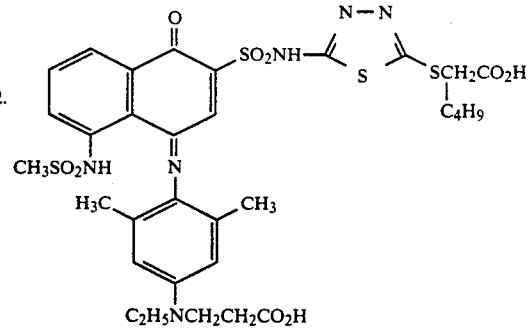
33.
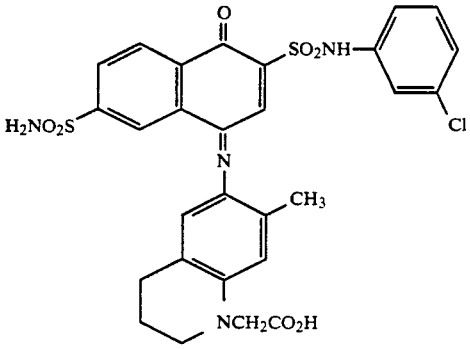
34.
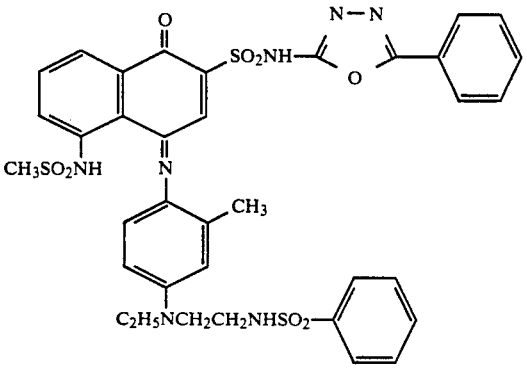
35.
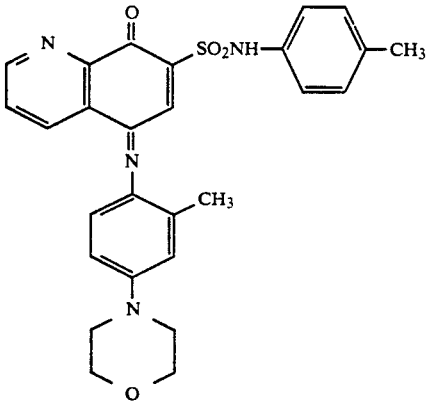
36.
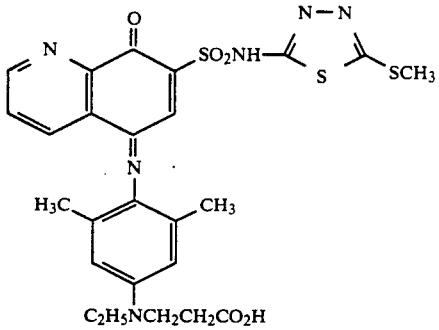
37.
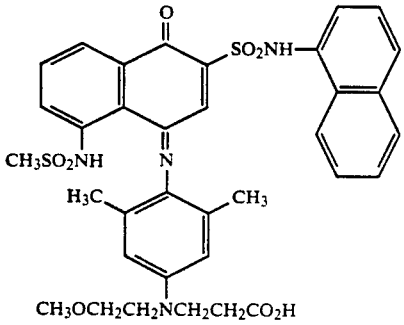
38.
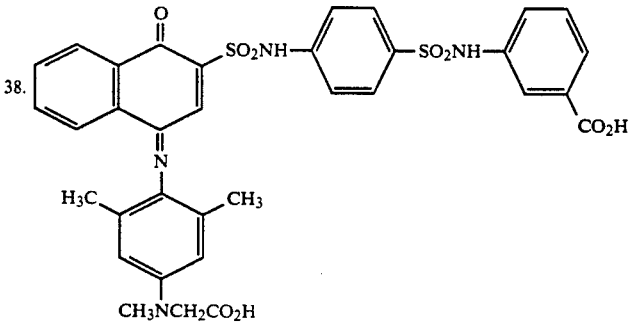

-continued

39.

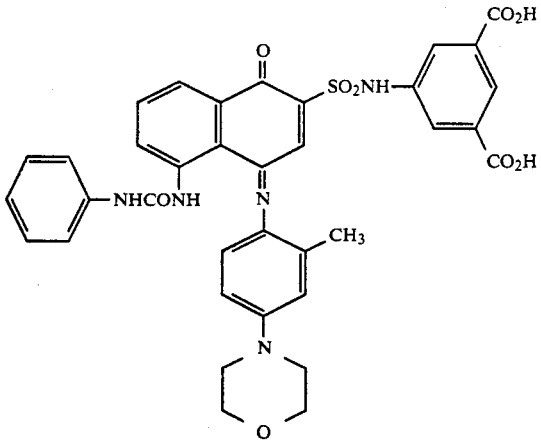

40.

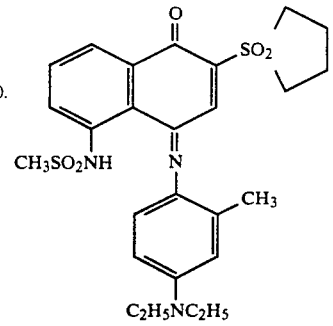

41.

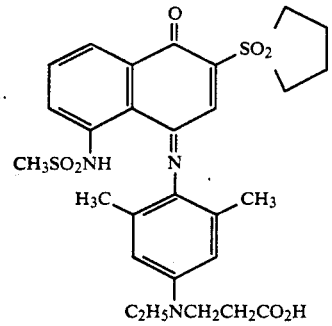

42.

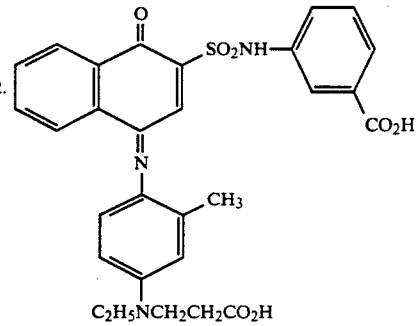

43.

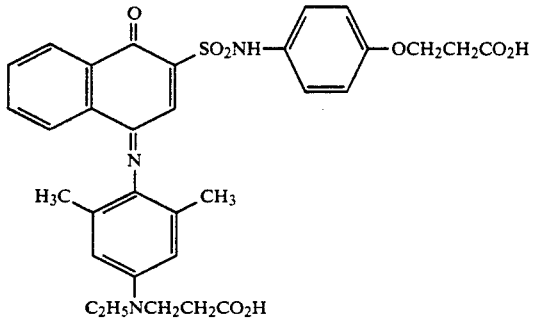

44.

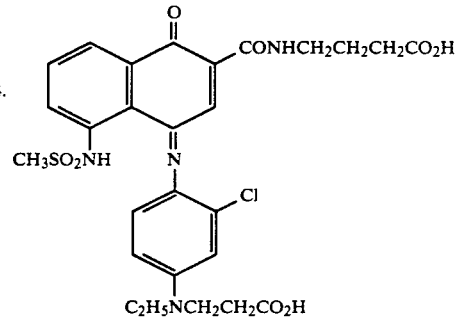

45.

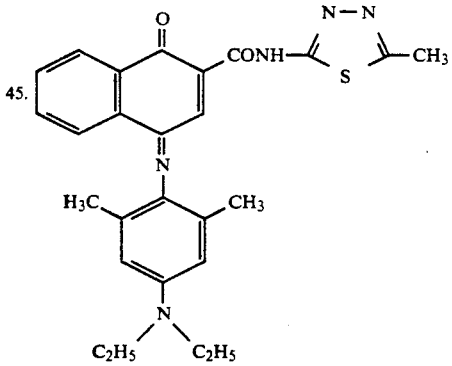

Compounds of the invention represented by general formula (I) can be synthesized by processes such as a process for condensation of a dialkylaniline and 4-nitrosonaphthol in concentrated sulfuric acid, a process for condensation of an α-naphthol and p-phenylenediamine in the presence of a base and an oxidizing agent, a process for oxidation-condensation of a 4-amino-1-napthol and a dialkylaniline in a sodium hypochlorite solution or a process for condensation of a p-nitrosodialkylaniline and α-naphthol; and they can be synthesized by following the procedures described in, e.g., JP-A-50-100116 and JP-A-60-32851 or by Fujita in the Journal of Organic Chemistry, Vol. 48 p. 177 to 183 (publ. 1983).

Procedures for synthesis of the compounds of the formula (I) are described below. Unless otherwise indicated herein, all parts, percents, ratios and the like are by weight.

SYNTHESIS EXAMPLE 1

Synthesis of Compound 45:

3.5 g of 4-diethylamino-2,6-dimethylaniline and an aqueous solution prepared using 40 ml of ethanol, 80 ml of ethyl acetate, 11 g of sodium carbonate and 110 ml of water were added to 4.3 g of 2-(1-hydroxy-2-naphthalenecarbonamido)-5-methyl-1,3,4-thiazole produced by heating 1-hydroxy-2-naphthalenecarboxylic acid phenyl ester and 2-amino-5-methyl-1,3,4-thiadiazole under reduced pressure, and while these materials were stirred, a solution prepared by dissolving 8.2 g of ammonium persulfate in 70 ml of water was added dropwise over a period of 30 minutes.

Next, after 2 hours of stirring, the ethyl acetate layer was removed and washed with water and the ethyl acetate was distilled off. The residue was dissolved in chloroform and then cooled, giving crystals of Compound 45.

Yield 1.2 g, melting point 181° to 182° C.

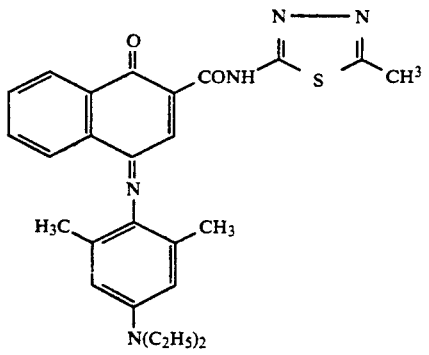

SYNTHESIS EXAMPLE 2

Synthesis of Compound 40

N,N-Dimethylformamide, methanol and ethanol were added to 3.7 g of 5-methanesulfonamido-2-(1-pyrrolidyl-sulfonyl)-1-napthol and then 1.9 g of 3-methyl-4-nitroso-N,N-diethylaniline was added and dissolved by stirring at room temperature. Six ml of acetic anhydride were added to this solution which was stirred for 1 hour. The precipitate that was produced was removed by filtering and washed with ethanol and then with methanol. The resulting crystals were dissolved in chloroform, and ethanol and methanol were added and it was then concentrated under reduced pressure, giving crystals of Compound 40. Yield 4.5 g (percentage yield 82.6%), absorption maximum wavelength : λmax ($CHCl_3$ solution) : 700 nm (molecular extinction coefficient : $3.48 \times 10^4$).

Generally, dyes of general formula (I) are used in an amount of about 1 to 1000 mg per 1 $m^2$ of photosensitive material surface area. Preferably, the amount is about 1 to 800 mg per 1 $m^2$.

When they are used as filter or antihalation dyes, the dyes of general formula (I) may be used to any amount that is effective but preferably they are used in an amount such that the optical density of the dye containing layer is in the range 0.05 to 3.5. The time of addition may be in any stage prior to coating.

The dyes according to the invention may equally well be used in emulsion layers and in other hydrophilic colloid layers.

The procedure for forming the dyes of the invention as a microcrystal dispersion can be, e.g., a procedure for forming a microcrystal dispersion by dissolution in a weakly alkaline solution and addition to a hydrophilic colloid layer followed by pH adjustment to make the material weakly acidic, a known method of milling in the presence of a dispersant, or a procedure such as ball milling, sand milling or colloid milling, etc. The dyes can also be added to an emulsion in the form of solutions in which they are dissolved in a solvent, e.g., methyl alcohol, ethyl alcohol, propyl alcohol, methylcellosolve, the halogenated alcohols disclosed in JP-A-48-9715 and U.S. Pat. No. 3,756,830, acetone, water or pyridine or mixtures of these solvents.

The dye grains in dispersions have an average grain diameter that is less than 10 μm and is preferably less than 1 μm.

Gelatin is typical as a hydrophilic colloid but use may be made of other conventionally known colloids that are employable for photographic purposes.

The silver halide emulsions employable in the invention can contain any of the halides: silver bromide, silver iodobromide, silver iodochlorobromide, silver chlororbromide and silver chloride. From the point of view of speeding up execution of processing, emulsions with a silver chloride content of 95 mol% or more are preferred.

The silver halide grains in the photographic emulsion layers may be grains with cubic, octahedral or similar regular crystals or be grains with spherical, tabular or similar irregular crystal form or they may be grains of composite from combining these crystal forms. They may also be mixtures of grains with a variety of different crystal forms.

The silver halide grains may have a uniform phase or they may have internal portions and surface layers with different phases. Further, they may be grains with which latent images are formed mainly on grain surfaces (as in, e.g., negative-type emulsions) or grains in which latent images are formed mainly in the grain interiors (as in, e.g., internal latent image type emulsions and prefogged direct reversal type emulsions).

The silver halide emulsions used in the invention may be tabular grains such that 50% or more of the total projected area of the grains is represented by grains with a thickness that is not more than 0.5 microns and preferably not more than 0.3 microns, a diameter that is preferably 0.6 microns or more and an average aspect ratio of 5 or more. Use of tabular emulsion grains with an aspect ratio of 5 or more in combination with the filter dyes of the invention is desirable since such a combination gives a silver halide color photographic material with markedly superior sharpness and color reproduction characteristics. Details of tabular emulsions and ways of using them are given in, e.g., *Research Disclosure,* Item 22534, p. 20 to 58 (Jan. 1983) and Item 22530, p. 237 to 240 (May 1985).

Further, the silver halide emulsions used in the invention may be monodisperse emulsions in which grains with a grain size that is within ±40% of the average grain size represent 95% or more of the grains numberwise.

The silver halide emulsions used in the invention can be prepared by methods such as those described in, e.g., P. Glafkides, *Chimie et Physique Photographique* (Paul Montel Co., (1967), G. F. Duffin, *Photographic Emulsion Chemistry* Focal Press, (1966) and V. L. Zelikman et al., *Making and Coating Photographic Emulsion* Focal Press (1964).

Examples of silver halide solvents that can be used in order to control grain growth at the time of formation of these silver halide grains include ammonia, potassium thiocyanate, ammonium thiocyanate, thioether compounds (as in, e.g., U.S. Pat. Nos. 3,271,157, 3,574,628, 3,704,130, 4,297,439 and 4,276,374), thione compounds (as in, e.g., JP-A-53-144319, JP-A-53-82408 and JP-A-55-77737) and amine compounds (as in, e.g., JP-A-54-100717).

Cadmium salts, zinc salts, lead salts, thallium salts, irridium salts or complex salts thereof, rhodium salts or complex salts thereof, and iron salts or complex salts thereof etc. may be present during the formation or physical ripening of the silver halide grains.

Normally, silver halide emulsions are chemically sensitized. This can be done by, e.g., the processes described in *Die Grundlaqen der Photographischen Prozesse mit Silberhalogeniden,* H. Frieser ed., Akademische Verlagsgesellschaft (1968), pages 675 to 734.

That is, processes such as the sulfur sensitization process using activated gelatin or sulfur containing compounds that can react with silver (e.g., thiosulfates, thioureas, mercapto compounds, rhodanines), the reduction sensitization process using reducing substances (e.g., stannous salts, amines, hydrazine derivatives, formamidinesulfinic acid, silane compounds) and the noble metal sensitization process using noble metal compounds (e.g., complex salts of gold or complex salts of periodic table group VIII metals such as Pt, Ir and Pd, etc.) can be used alone or in combination.

A variety of compounds can be included in the photographic emulsions that are used in the invention for the purpose of preventing fogging and stabilizing the photographic properties in the course of photographic material manufacture and during storage and photographic processing. That is, many compounds that are known as antifoggants or stabilizers, examples including azoles, e.g., benzothiazolium salts, nitroindazoles, triazoles, benzotriazoles, benzimidazoles (especially nitro or halogen substitution products); heterocyclic mercapto compounds, e.g., mercaptothiazoles, mercaptobenzothiazoles, mercaptobenzimidazoles, mercaptothiadiazoles, mercaptotetrazoles (especially 1-phenyl-5-mercaptotetrazole), mercapto pyrimidines; heterocyclic mercapto compounds as noted above that possess water-soluble groups such as carboxyl or sulfone groups; thioketo compounds such as oxazolinethione; azaindenes, such as tetra-azaindenes (especially 4-hydroxysubstituted (1,3,3*a*,7)tetra-azaindenes); benzenethiosulfonic acid and benzene sulfonic acid may be added.

A variety of color couplers can be used in the invention. Specific examples are described in the patents listed in the above-noted *Research Disclosure,* No. 17643, VII—C–G. Couplers which give the three primary colors for a subtractive color system (i.e., yellow, magenta and cyan) in color development are important as dye-forming couplers and specific examples of diffusion-resistant 4-equivalent or 2-equivalent couplers are given in the patents noted in *Research Disclosure,* No. 17643, Items VII—C and D, and apart from these the following couplers may suitably be used in the invention.

Known oxygen atom elimination type yellow couplers and nitrogen atom elimination type yellow couplers can be cited as typical examples of yellow couplers that are employable in the invention. The color dye fastness, especially the light-fastness, is excellent with α-pivaloylacetanilide couplers, while α-benzoylacetanilide couplers give high color density.

Hydrophobic 5-pyrazolone and pyrazoloazole couplers possessing ballast groups can be cited as magenta couplers that are employable in the invention. Within 5-pyrazolone couplers, couplers with the 3-position substituted by an arylamino or acylamino group are preferred from the point of view of coupler dye hue and coloring density.

Cyan couplers that can be used in the invention also include hydrophobic, diffusion-resistant naphtholic and phenolic couplers, typical examples of preferred compounds being oxygen atom elimination type 2-equivalent naphtholic couplers. Preferably, use is made of couplers which can form cyan dyes that are fast to temperature and humidity. Typical examples of such couplers include the phenolic cyan couplers disclosed in U.S. Pat. No. 3,772,002 which have ethyl or higher alkyl groups in the phenol nucleus meta positions, 2,5-diacylamino-substituted phenolio couplers and phenolic couplers which have phenylureido groups in 2-positions and acylamino groups in 5-positions.

Graininess can be improved by the joint use of couplers in which the coupling dyes possess a suitable degree of diffusibility. Specific examples of such couplers are the magenta couplers disclosed in U.S. Pat. No. 4,366,237 and the yellow, magenta and cyan couplers in European Patent 96,570.

The dye-forming couplers and the above-noted specific couplers may form dimers or higher polymers. Typical examples of polymerized dye-forming couplers are given in, e.g., U.S. Pat. No. 3,451,820. Specific examples of polymerized magenta couplers are given in, e.g., U.S. Pat. No. 4,367,282.

Other couplers that can suitably be employed in the invention are couplers by which photographically useful residual groups are released on coupling. The couplers of the patents noted in *Research Disclosure,* No. 17643, Items VII—F are useful as DIR couplers that release development inhibitors.

Couplers which release development acceleration agents or nucleating agents in an image wise manner or precursors of such agents at the time of development can be used in the photographic material of the invention. Specific examples of such compounds are given in U.K. Patents 2,097,140 and 2,131,188.

Substances such as, e.g., polyalkylene oxides or ether, ester, amine or similar derivatives thereof, thioether compounds, thiomorpholines, quaternary ammonium salts, urethane derivatives, urea derivatives, imidazole derivatives and 3-pyrazolidones may be included in the photographic emulsions of the invention in order to improve speed and contrast or to speed-up development.

As well as the dyes disclosed for use in this invention, known water-soluble dyes (e.g., oxonol, hemioxonol and merocyanine dyes) may be used conjointly in the silver halide photographic emulsions of the invention to serve as filter dyes or for the prevention of irradiation or various other purposes. Also, known cyanine, merocyanine and hemicyanine dyes other than the dyes disclosed by the invention may be used conjointly as spectral sensitizers.

The photographic emulsions of the invention may include coating assistants and a variety of surfactants for various purposes such as prevention of static electricity, improvement of slip characteristics, emulsification and dispersion, prevention of adhesion and improvement of photographic characteristics (e.g., acceleration of development, hardening, gradation and sensitization).

Specific details of color fading preventives, hardeners, color fogging preventives, ultraviolet light absorbers, gelatin and other protective colloids and various additives for the photosensitive material of the invention are given in, e.g., *Research Disclosure,* No. 17643.

Finished emulsions are coated on a suitable support, e.g., baryta paper, resin-coated paper, synthetic paper, triacetate film, polyethylene terephthalate film or similar synthetic resin bases or glass plates.

The silver halide photographic material of the invention may be used as color positive films, color papers, color negative films, color reversal materials (including both the case where couplers are included and the case where couplers are not included), photographic materials for platemaking (e.g., lith film, lith duplicating film), photosensitive materials for cathode ray tube displays (e.g., photosensitive materials for emulsion X ray recording, materials for direct or indirect photography using screens etc.), photosensitive materials for silver salt diffusion transfer processes or photosensitive materials for color diffusion transfer processes, and any known processing solution and known methods such as described in the above-noted *Research Disclosure,* No. 17643 may be employed for the dye transfer processes. The processing temperature is normally set at a temperature of 18° to 50° C., although it may be lower than 18° C. or higher than 50° C. Particularly desirable effects are achieved when they are used for color photographic processing consisting of image processing to form dye images.

Color development solutions are generally alkaline aqueous solutions continuing color developing agents as main components. The color developing agents used can be known primary aromatic amine developing agents such as, for example, phenylene diamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline).

In addition to these, for example, the substances disclosed by, e.g., L. F. A. Mason *Photographic Processing Chemistry* Focal Press, (1966), p. 226 to 229 and in U.S. Pat. Nos. 2,193,015 and 2,592,364 and JP-A-48-64933 can be used.

The processing solution may also contain pH buffers such as alkali metal sulfites, bisulfites, carbonates, borates and phosphates and development inhibitors or antifoggants such as bromides, iodides and organic antifoggants. If required, hard water softeners, preservatives such as hydroxylamines, organic solvents such as benzyl alcohol or diethylene glycol, polyethylene glycol, quaternary ammonium salts, amines and similar development accelerators, dye-forming couplers, competitive couplers, fogging agents such as sodium boron halides, auxiliary developing agents such as 1-phenyl-3-pyrazolidone, viscosity improvers, the polycarboxylic acid chelating agents disclosed in U.S. Pat. No. 4,083,723 and the antioxidants disclosed in West German Patent Application (OLS) 2,622,950 may also be included.

The development solution pH is preferably 8 or more and still more preferably it is 9 or more. The concentration of sulfites or bisulfites in the development solution is preferably not less than $10^{-3}$ moles/liter and still more preferably it is not less than $10^{-2}$ moles/liter.

It is preferable to include sulfites or bisulfites in fixing solutions or bleach-fixing solutions.

One may make joint use of known compounds as bleaching acceleration agents in the bleaching solution or bleach-fixing solution or their prebaths, examples of such compounds including the compounds with mercapto or disulfide groups described in U.S. Pat. No. 3,893,858, German Patents 1,290,812 and 2,059,988, JP-A-53-32736, JP-A-53-57831, JP-A-53-37418, JP-A-53-65732, JP-A-5372623, JP-A-53-95630, JP-A-53-95631, JP-A-53-104232, JP-A-53-124424, JP-A-53-141623, JP-A-53-28426 and *Research Disclosure,* No. 17129, thiazolidine derivatives such as those described in JP-A-50-140129, the thiourea derivatives described in JP-B-45-8506 (the term "JP-B" as used herein means an "examined Japanese patent publication), JP-A-52-20832, JP-A-53-32735 and U.S. Pat. No. 3,706,561, the iodides described in German Patent 1,127,715 and JP-A-58-16235, the polyethylene oxides described in German Patents 966,410 and 2,748,430, the polyamines disclosed in JP-B-45-8836 and the compounds described in JP-A-49-42434, JP-A-49-59644, JP-A-53-94927, JP-A-54-35727, JP-A-55-26506 and JP-A-58-163940.

As well as the above-noted color development and bleaching stages, the processing method in the invention also comprises stages such as fixing, etc. Generally, steps such as washing and stabilization, etc. are carried out following the fixing or bleach-fixing stage but it is also possible to employ a simplified processing procedure in which only a washing stage is performed or, conversely, there is essentially no washing stage and only stabilization processing is effected.

Processing solutions for stabilizing dye images are used as stabilization solutions in the stabilization stage. For example, a solution with a buffering capacity to give a pH of 3 to 6 or solutions containing an aldehyde (e.g., formaldehyde) can be used. If required, fluorescent brightening agents, chelating agents, batericides, antifungal agents, hardeners or surfactants, etc. can be used in the stabilization solutions.

If required, the stabilization stage may be performed using two or more tanks and water can be economized by multistage counter-current stabilization (e.g., using 2 to 9 stagas) or washing may even be dispensed with.

Known additives can be included in the washing water used in the washing stage if required. For example, use can be made of inorganic phosphoric acid, aminopoly-carboxylic acid, organic phosphoric acid or similar chelating agents various types of bactericides and antifungal agents for preventing growth of bacteria and algae, film hardeners such as magnesium or aluminum salts and surfactants for preventing drying loads and unevenness. It is also possible to use compounds such as described by, e.g., L. E. West in "Water Quality Criteria" (*Photographic Science and Engineering,* Vol. 9, No. 6, pages 344 to 359 (1965)).

If required the washing stage can be performed using two or more tanks and washing water may be economized by use of multistage counter-current washing (e.g., with 2 to 9 stages).

The invention offers the excellent advantage that the dyes of dye layers in its silver halide photographic material display suitable spectral absorption and they dye the dye layers selectively without diffusion to other layers.

The silver halide photographic material containing compounds of general formula (I) according to the invention offers the advantages that photographic processing results in easy decoloration or elution, that it gives a low Dmin without reduction of speed and that there is little reduction of speed in storage.

Further, the silver halide photographic material of the invention gives images with improved sharpness, in addition to which photographs produced using the silver halide photographic material of the invention are free from formation of stains and are stable and are not subject to deterioration of photographic performance even in long-term storage.

As they absorb radiation in the near-infrared region, the compounds of the invention are preferably used in photosensitive material that is spectrally sensitized to radiation of 700 nm or more.

The present invention is described in further detail by reference to the following examples.

EXAMPLE 1

Silver Halide Emulsion Preparation 32 g of lime-treated gelatin was added to 1000 ml of distilled water and after it was dissolved at 40° C., 3.3 g of sodium chloride was added and the temperature was raised to 52° C. 3.2 ml of N,N-dimethylimidazolidine-2-thione (1% aqueous solution) were added to this solution. Next, taking 14 minutes and with the temperature still held at 52° C., a solution in which 32.0 g of silver nitrate had been dissolved in 200 ml of distilled water and a solution in which 11.0 g of sodium chloride had been dissolved in 200 ml of distilled water were added and mixed with the solution. Then, taking 20 minutes and with the temperature held at 52° C. (1) a solution in which 128.0 g of silver nitrate was dissolved in 560 ml of distilled water and (2) a solution in which 44.0 g of sodium chloride and 0.1 mg of potassium hexachloroiridate (IV) were dissolved in 560 ml of distilled water, were added and mixed. After 15 minutes at 52° C., the temperature was lowered to 40° C. and the material was desalted and washed. Further addition of lime-treated gelatin gave Emulsion (A). The emulsion produced was one containing cubic silver chloride grains with an average grain size of 0.45 μ and a grain size distribution variation coefficient of 0.08.

A silver chlorobromide Emulsion (B) containing 2 mol% of silver bromide was produced by making an alteration to Emulsion (A) such that the sodium chloride aqueous solution that was added together with the silver nitrate aqueous solution was changed to a mixed solution of sodium chloride and potassium bromide (with the total number of moles kept the same and the molar ratio made 98:2). The times taken to add the reaction solutions were adjusted so as to make the average grain size of the silver halide grains contained in the emulsion equal to that of the grains in Emulsion (A). The resulting grains were cubic and their grain size variation coefficient was 0.08.

A silver chlorobromide Emulsion (C) containing 10 mol% of silver bromide was produced by making an alteration to Emulsion (A) such that the sodium chloride aqueous solution that was added together with the silver nitrate aqueous solution was changed to a mixed solution of sodium chloride and potassium bromide (with the total number of moles kept the same and the molar ratio made 9:1). The times taken to add the reaction solutions were adjusted so as to make the average grain size of the silver halide grains contained in the emulsion equal to that of the grains in Emulsion (A). The resulting grains were cubic and their grain size variation coefficient was 0.09.

After adjustment of the pH and pAg values, the three emulsions thus produced were each given optimum chemical sensitization treatment by addition of triethylthiourea, so giving Emulsions (A-1), (B-1) and (C-1).

Separately from these emulsions, there was also prepared a micrograin silver bromide Emulsion ((a-1) containing $2.5\times10^{-5}$ mol of potassium hexachloroiridate (IV) per 1 mol of silver bromide) in which the average grain size was 0.05 μ.

An emulsion was prepared by adding Emulsion (a-1) to Emulsion (A) in an amount that was equivalent to 2 moles in terms of silver halide and then effecting optimum chemical sensitization by addition of triethylthiourea and this emulsion was designated as Emulsion (A-2).

A stabilizer in the form of the following compound was added to each of these four silver halide emulsions in an amount that was $5.0\times10^{-4}$ mol per 1 mole of silver halide.

Stabilizer (I-1)

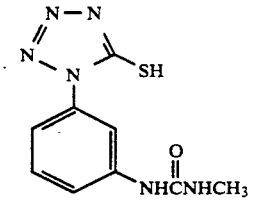

The halogen compositions and distributions in the four silver halide emulsions produced were determined by an X ray diffraction procedure.

It was found that Emulsion (A-1) displayed a 100% silver chloride, Emulsion (B-1) a 98% silver chloride (2% silver bromide) and Emulsion (C-1) a 90% silver chloride (20% silver bromide) single diffraction peak. In the case of Emulsion (A-2), as well as a 100% silver chloride main peak a broad subsidiary peak centering on 70% silver chloride (30% silver bromide) and with a base spreading to the vicinity of 60% silver chloride (40% silver bromide) was observed.

SOLID MICROGRAIN DISPERSIONS OF DYES

Dye crystals with the compositions shown below were milled and ground to micrograins (with an average diameter of 0.15 μm or less) by a sand mill. Next, in each case they were dispersed in 25 ml of a 10% lime-treated gelatin aqueous solution in which 0.1 g of citric acid was dissolved, the sand that had been used was removed by means of a glass filter and dye that was adsorbed by the sand on the glass filter was washed off using hot water, so producing 100 ml of a 7% gelatin aqueous solution which was used as solid micrograin dye dispersion.

| Dispersion A | |
|---|---|
| Dye (I-3) | 0.8 g |

-continued

| | |
|---|---|
| Dye (I-14) | 1.5 g |
| 5% Aqueous Solution of Surfactant (Cpd-10) | 5 ml |
| Dispersion B | |
| Dye (I-3) | 0.8 g |
| Dye (I-27) | 1.5 g |
| 5% Aqueous Solution of Surfactant (Cpd-10) | 5 ml |
| Dispersion C | |
| Dye (I-3) | 2 g |
| 5% Aqueous Solution of Surfactant (Cpd-11) | 5 ml |

PRODUCTION OF COLOR PHOTOGRAPHIC MATERIAL

Next, emulsified dispersions of couplers, etc. were prepared, combined with the various silver halide emulsions and coated on paper supports that were laminated with polyethylene on both sides and multilayer color photographic materials with the following layer structures were produced.

LAYER STRUCTURES

The compositions of the various layers were as follows. The figures indicate coating quantities (g/m$^2$; but ml/m$^2$ in the case of solvents). The values for the silver halide emulsions are given as values converted to amounts of coated silver.

| | |
|---|---|
| Support | |
| Polyethylene-laminated paper (with the polyethylene on emulsion layer side containing white pigment ($TiO_2$) and blue dye (ultramarine)) | |
| First Layer (antihalation layer) | |
| Gelatin | 0.80 |
| Dye (solid micrograin dispersion) (Table 1) | |
| Second Layer (yellow dye forming layer) | |
| Silver Halide Emulsion (Table 1) | 0.30 |
| Spectral Sensitizing Dye (Table 1) | |
| Yellow Coupler (Y-1) | 0.82 |
| Color Image Stabilizer (Cpd-7) | 0.09 |

-continued

| | |
|---|---|
| Solvent (Solv 6) | 0.28 |
| Gelatin | 1.75 |
| Third Layer (color mixing prevention layer) | |
| Gelatin | 1.25 |
| Filter Dye (Dye-4) | 0.01 |
| Color Mixing Preventing Agent (Cpd-4) | 0.11 |
| Solvent (Solv 2) | 0.24 |
| Solvent (Solv 5) | 0.26 |
| Fourth Layer (magenta dye forming layer) | |
| Silver Halide Emulsion (Table 1) | 0.12 |
| Spectral Sensitizing Dye (Table 1) | |
| Supersensitizer (Table 1) | |
| Magenta Coupler (M-1) | 0.13 |
| Magenta Coupler (M-2) | 0.09 |
| Color Image Stabilizer (Cpd-1) | 0.15 |
| Color Image Stabilizer (Cpd-8) | 0.02 |
| Color Image Stabilizer (Cpd-9) | 0.03 |
| Solvent (Solv 1) | 0.34 |
| Solvent (Solv 1) | 0.17 |
| Gelatin | 1.25 |
| Fifth Layer (ultraviolet light absorption layer) | |
| Gelatin | 1.58 |
| Filter Dye (Dye-5) | 0.05 |
| Ultraviolet Light Absorber (UV-1) | 0.47 |
| Color Mixing Preventing Agent (Cpd-4) | 0.05 |
| Solvent (Solv 3) | 0.26 |
| Sixth Layer (cyan dye forming layer) | |
| Silver Halide Emulsion (Table 1) | 0.23 |
| Spectral Sensitizing Dye (Table 1) | |
| Supersensitizer (Table 1) | |
| Cyan Coupler (C-1) | 0.32 |
| Color Image Stabilizer (Cpd-5) | 0.17 |
| Color Image Stabilizer (Cpd-6) | 0.04 |
| Color Image Stabilizer (Cpd-7) | 0.40 |
| Solvent (Solv 4) | 0.15 |
| Gelatin | 1.34 |
| Seventh Layer (ultraviolet light absorption layer) | |
| Gelatin | 0.53 |
| Ultraviolet Light Absorber (UV-1) | 0.16 |
| Color Mixing Preventing Agent (Cpd-4) | 0.02 |
| Solvent (Solv 3) | 0.09 |
| Eighth Layer (protective layer) | |
| Gelatin | 1.33 |
| Polyvinyl Alcohol Acryl-modified Copolymer (degree of modification 17%) | 0.17 |
| Liquid Paraffin | 0.03 |

14.0 mg of 1-oxy-3,5-dichloro-s-triazine sodium salt per 1 g of gelatin was used as a gelatin hardener for each layer.

Yellow Coupler (Y-1)

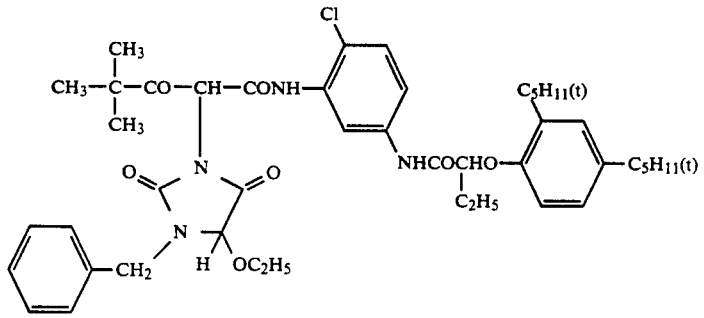

Cyan Coupler (C-1)

2:4:4 mixture (weight ratio) of the compounds

-continued
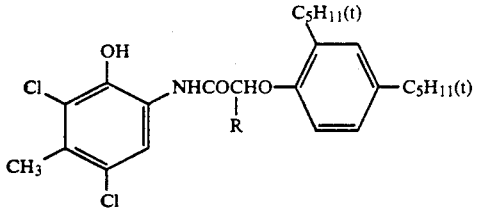
in which R = $C_2H_5$ and R = $C_4H_9$ and
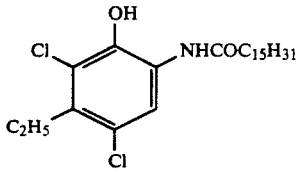
Magenta Coupler (M-1)
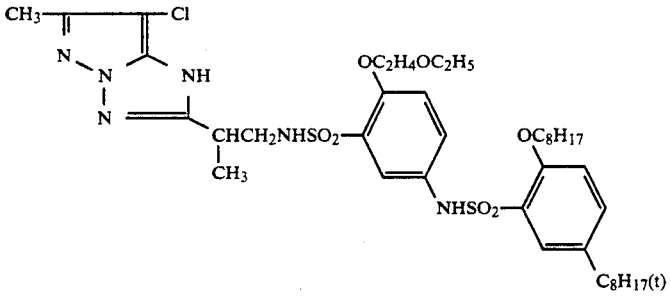
Magenta Coupler (M-2)
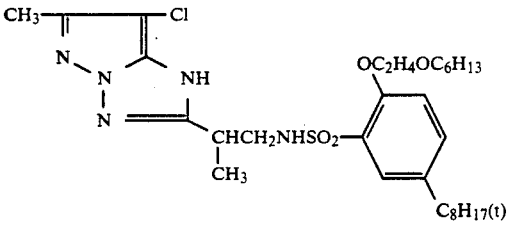
Color Image Stabilizer (Cpd-1)
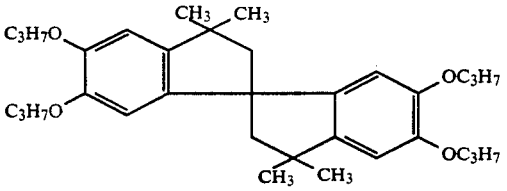
Color Image Stabilizer (Cpd-2)
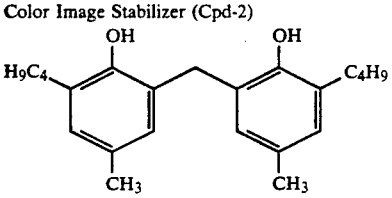
Color Image Stabilizer (Cpd-3)
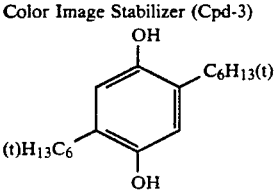
Color Mixing Preventing Agent (Cpd-4)

-continued
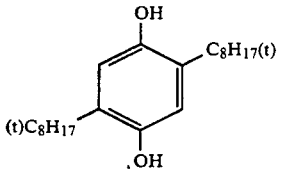
Color Image Stabilizer (Cpd-5)
2:4:4 mixture (weight ratio) of:
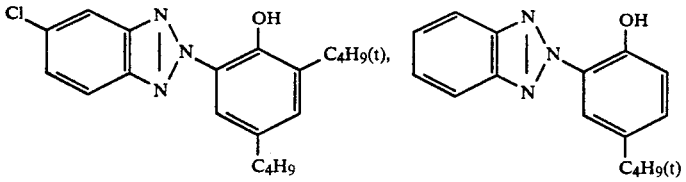
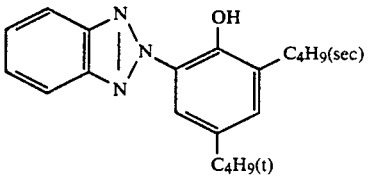
Color Image Stabilizer (Cpd-6)
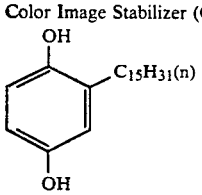
Color Image Stabilizer (Cpd-7)
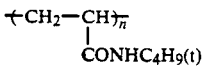
Color Image Stabilizer (Cpd-8)
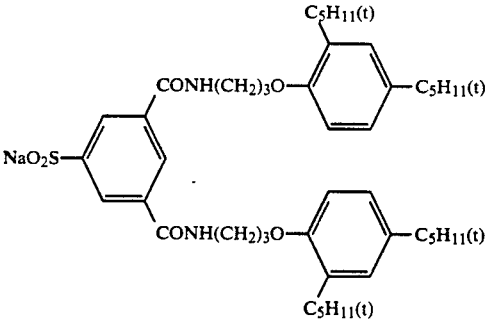
Color Image Stabilizer (Cpd-9)
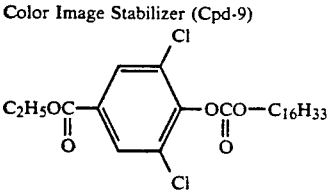
Surfactant (Cpd-10)
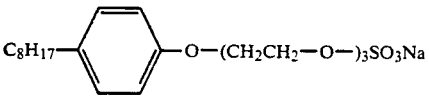
(Cpd-11)

-continued
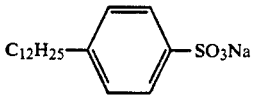
Supersensitizer (Cpd-12)
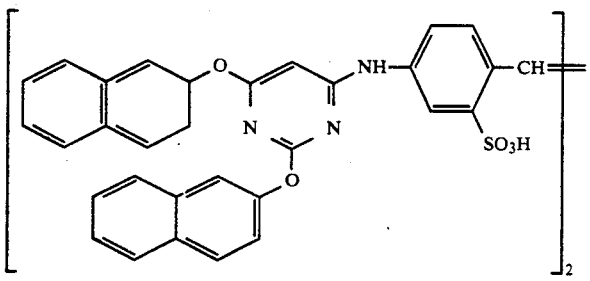
Supersensitizer (Cpd-13)
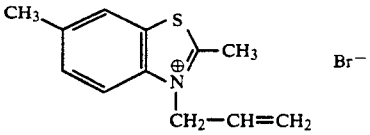
Solvent (Solv-1)
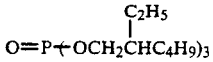
Solvent (Solv-2)
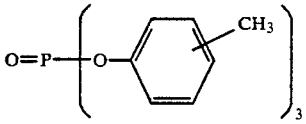
Solvent (Solv-3)
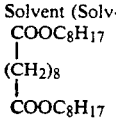
Solvent (Solv-4)
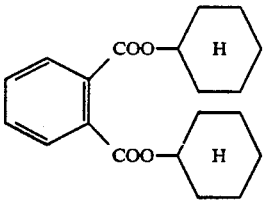
Solvent (Solv-5)
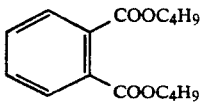
Solvent (Solv-6)
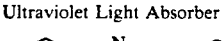
Ultraviolet Light Absorber (UV-1)
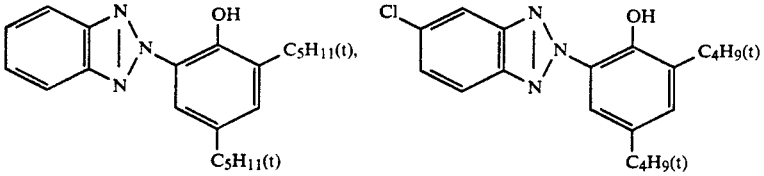

-continued

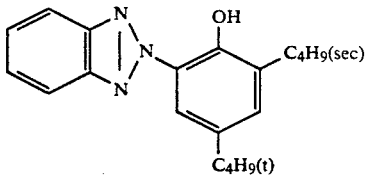

Dye 1

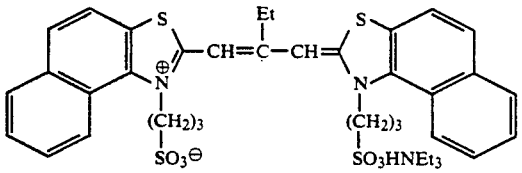

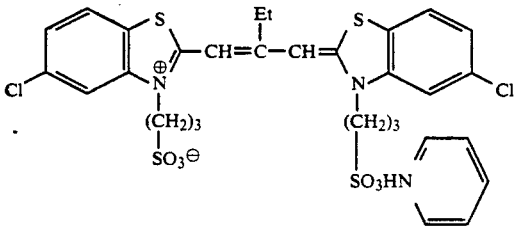

$3.2 \times 10^{-5}$ mol, $2.7 \times 10^{-5}$ mol per 1 mole of silver halide

Dye-2

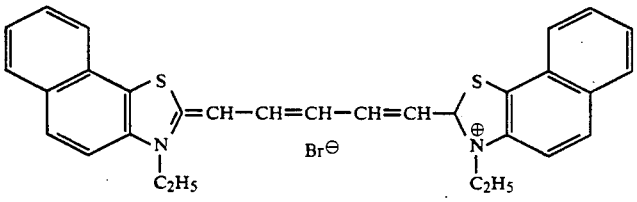

$3.5 \times 10^{-5}$ mol per 1 mole of silver halide was added and joint use was made of $2.6 \times 10^{-3}$ mol/Ag of Cpd-12.

Dye-3

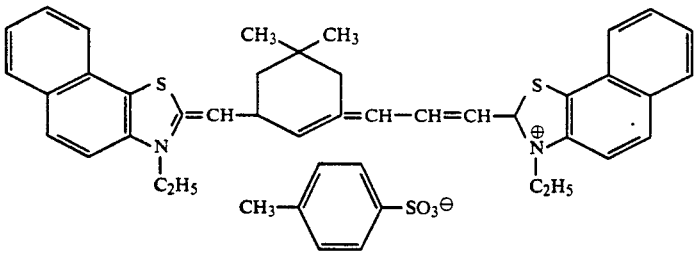

$1.7 \times 10^{-5}$ mol per 1 mole of silver halide was added and joint use was made of $2.6 \times 10^{-3}$ mol/Ag of Cpd-12 and $1 \times 10^{-3}$ mol/Ag of Cpd-13.

Dye-4

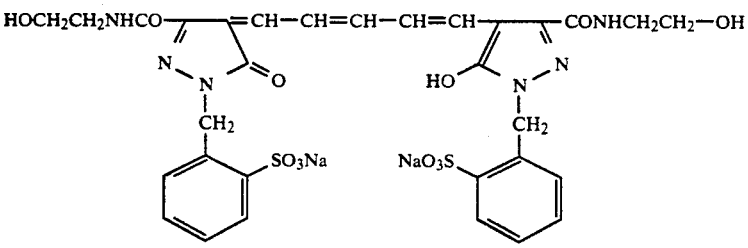

10 mg per $m^2$ of coated film
(for filter purposes and prevention of irradiation)

-continued

Dye-5

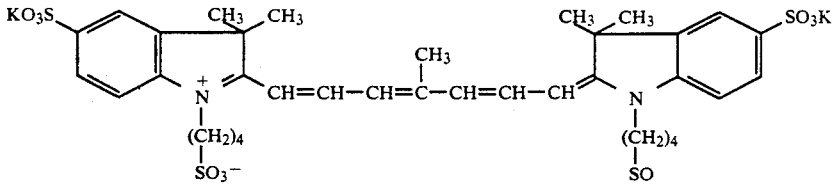

5 mg per $m^2$ of coated film
(for filter purposes and prevention of irradiation)

TABLE 1

| Photographic Mterial Sample No. | Dye | Silver Halide Emulsion | Sensitizing Dye | Supersensitizer | Dye | Silver Halide Emulsion | Sensitizing Dye | Supersensitizer |
|---|---|---|---|---|---|---|---|---|
| | | 1 | | | | 2 | | |
| 1st Layer (antihalation) | | | | | 1-3 . . . 16 mg<br>1-14 . . . 30 mg | | | |
| 2nd Layer (yellow forming) | | A-1 | Dye-1 | — | | A-1 | Dye-1 | — |
| 4th Layer (magenta forming) | | A-2 | Dye-2 | Cpd-12<br>Cpd-13 | | A-2 | Dye-2 | Cpd-12<br>Cpd-13 |
| 6th Layer (cyan forming) | | A-2 | Dye-3 | Cpd-12<br>Cpd-13 | | A-2 | Dye-3 | Cpd-12<br>Cpd-13 |
| | | 3 | | | | 4 | | |
| 1st Layer (antihalation) | 1.3 . . . 27 mg<br>1-14 . . . 50 mg | | | | 1-3 . . . 27 mg<br>1-27 . . . 50 mg | | | |
| 2nd Layer (yellow forming) | | A-1 | Dye-1 | — | | A-1 | Dye-1 | — |
| 4th Layer (magenta forming) | | A-2 | Dye-2 | Cpd-12<br>Cpd-13 | | A-2 | Dye-2 | Cpd-12<br>Cpd-13 |
| 6th Layer (cyan forming) | | A-2 | Dye-3 | Cpd-12<br>Cpd-13 | | A-2 | Dye-3 | Cpd-12<br>Cpd-13 |
| | | 5 | | | | 6 | | |
| 1st Layer (antihalation) | 1.3 . . . 27 mg<br>1-14 . . . 50 mg | | | | 1-3 . . . 27 mg<br>1-14 . . . 50 mg | | | |
| 2nd Layer | | B-1 | Dye-1 | — | | A-2 | Dye-1 | — |
| 4th Layer | | C-1 | Dye-3 | Cpd-12<br>Cpd-13 | | A-2 | Dye-2 | Cpd-12<br>Cpd-13 |
| 6th Layer | | C-1 | Dye-2 | Cpd-12<br>Cpd-13 | | B-1 | Dye-3 | Cpd-12<br>Cpd-13 |
| 3rd Layer (antihalation) | | | | | 1-3 . . . 10 mg | | | |
| | Cyan forming layer and magenta forming layer inverted | | | | Cyan forming layer and yellow forming layer inverted | | | |

The above samples were exposed to laser light. The laser exposure apparatus described under "Laser Apparatus 1" below was used for samples in which Dye-1, Dye-2 and Dye-3 were used as sensitizing dyes.

The exposure apparatus used in the examples is described below.

LASER EXPOSURE APPARATUS 1

Use was made of semiconductor lasers in the form of AlGaInp (oscillation wavelength about 670 nm), GaAlAs (oscillation wavelength about 750 nm) GaAlAs (oscillation wavelength about 830 nm) lasers. The apparatus was so assembled that each type of laser light could effect scanning exposure of a color printing paper moving normally to the direction of scanning by the action of a rotating polyhedron. The amount of exposure was controlled by electrical control of the semiconductor laser exposure time.

Using this Laser Exposure Apparatus 1, exposure was effected with outputs controlled so that the width of lines drawn by each of the laser light beams with respective wavelengths of about 670 nm, 750 nm and 830 nm was about 50 μm. Development was effected using the processing steps noted below.

Also, exposure for the purpose of resolution measurements was effected in the form of exposure of each type of sample while it was in close contact with a CTF measurement chart. For the illumination in this exposure, light from a xenon light source was passed through IF-S type bandpass filters that were manufactured by Nippon Shinku Kogaku KK and had maximum pass wavelengths of 670 nm, 750 nm and 830 nm respectively and the amount of light was regulated by means of an ND filter. The exposure time was about $10^{-4}$ seconds. Development was effected by the processing steps noted below. The density measurements of the resulting yellow, magenta and cyan colored images were made using a micro-reflecting densitometer and a 5 μm×400 μm aperture and CTF curves were prepared.

The sharpness of the edge cutoff of the line images produced by exposure with semiconductor laser light and their number of lines/mm values at a CTF value of 0.5 are indicated in Table 2.

The processing steps and the compositions of the various processing solutions were as follows.

| Processing Step | Temperature | Time |
|---|---|---|
| Color Development | 35° C. | 45 seconds |
| Bleach-Fixing | 30 to 35° C. | 45 seconds |
| Rinse (1) | 30 to 35° C. | 20 seconds |
| Rinse (2) | 30 to 35° C. | 20 seconds |
| Rinse (3) | 30 to 35° C. | 20 seconds |
| Rinse (4) | 30 to 35° C. | 20 seconds |
| Drying | 70 to 80° C. | 60 seconds |

(A Rinse (4) → (1) 3-tank counterflow system was used.)

The compositions of the various processing solutions were as follows.

| | |
|---|---|
| Color Developing Solution | |
| Water | 800 ml |
| Ethylenediamine-N,N,N,N-tetramethylphosphonic Acid | 1.5 g |
| Triethylenediamine-(1,4-diazabicyclo[2,2,2]octane) | 5.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N,-Diethylhydroxylamine | 4.2 g |
| Fluorescent Brightening Agent (UVITEX CK, Ciba Ceigy AG) | 2.0 g |
| Water to make | 1000 ml |
| pH (25° C.) | 10.10 |
| Bleach-Fixing Solution | |
| Water | 400 ml |
| Ammonium Thiosulfate (70% Aq. soln) | 100 ml |
| Sodium Sulfite | 18 g |
| Iron (III) Ammonium Ethylenediaminetetraacetate | 55 g |
| Disodium Ethylenediaminetetraacetate | 3 g |
| Ammonium Bromide | 40 g |
| Glacial Acetic Acid | 8 g |
| Water to make | 1000 ml |
| pH (25° C.) | |
| Rinse Solution | |
| Ion exchanged water (with both calcium and magnesium at not more than 3 ppm) | |

TABLE 2

| Photographic Material | Resolving Power (CTF 50) (lines/mm) | | | Edge Sharpnes (Visual examination) | | |
|---|---|---|---|---|---|---|
| Sample No. | Yellow | Magenta | Cyan | Yellow | Magenta | Cyan |
| 1 (Comparison example) | 15 | 19 | 11 | X | X | X |
| 2 (Invention) | 17 | 23 | 22 | Δ | ○ | ○ |
| 3 (Invention) | 18 | 25 or more | 24 | Δ | ○ | ○ |
| 4 (Invention) | 19 | 25 or more | 25 | ○ | ○ | ○ |
| 5 (Invention) | 17 | 25 | 25 or more | Δ | ○ | ○ |
| 6 (Invention) | 24 | 25 or more | 21 | ○ | ○ | ○ |

○ Sharp
Δ Ordinary
X Blurred

The invention makes possible a marked improvement in resolving power and edge sharpness. Sample-4 and Sample-6 in particular give good edge sharpness for images of all the colors yellow, magenta and cyan. With Sample-6, there was a slight reduction in the speed of the Second Layer (cyan dye forming) but excellent images were produced with particularly high chroma (good color separation) for yellow, magenta and cyan images.

EXAMPLE 2

The amount of Dye-5 added to the Fifth Layer in Sample 1 of Example 1 was increased to 30 mg per $m^2$ of coated film to produce Sample 7. Sample 7 and Sample 2 were subjected to optical wedge exposure by illuminatlon by the above noted xenon light source via a bandpass filter with a maximum transmittance of 750 nm. They were developed using the processing steps noted above and density measurements of the magenta images produced were made for a comparison of speeds. Also, the resolving power (lines/mm at CTF 50%) was determined in the same way as in Example 1. The results are given in Table 3 below.

TABLE 3

| Photographic Material Sample No. | Relative Speed (*standard) | Fogging (including residual color portions) | Resolving power (lines/mm) |
|---|---|---|---|
| 1 (Comparison) | 100* | 0.14 | 19 |
| 2 (Invention) | 84 | 0.12 | 23 |
| 7 (Comparison) | 63 | 0.13 | 23 |

When the amount of dye was increased as in the conventional procedure in order to make the resolving power equal to that of Sample 2, there was an even more marked decrease in speed and there tended to be more fogging (including residual color portions).

EXAMPLE 3

50 g of gelatin were dissolved in water and 3.1 g respectively of the various dyes noted in Table 1 were added thereto. 30 ml of a 4 wt% aqueous solution of sodium dodecylbenzenesulfonate as a surfactant and 45 ml of a 1 wt% aqueous solution of 1-hydroxy-3,5-dichlorotriazine sodium salt as a hardener were also added and the solid dye micrograin dispersions noted below was added. The constituent dye crystals were milled and ground to micrograins (with an average diameter of 0.15 μm or less) with a sand mill. Next, in each case they were dispersed in 25 ml of a 10% lime-treated gelatin aqueous solution in which 0.1 g of citric acid was dissolved, the sand that had been used was removed by means on a glass filter. Dye that was adsorbed by the sand on the glass filter was washed off by hot water, so producing 100 ml of a 7% gelatin aqueous solution.

| | |
|---|---|
| Dispersion A | |
| Dye (I-14) | 1.5 g |
| 5% Aqueous Solution of Surfactant (Cpd-10) | 5 ml |
| Dispersion B | |
| Dye (I-27) | 1.5 g |
| 5% Aqueous Solution of Surfactant (Cpd-10) | 5 ml |

For comparison, a solution of Comparison Dye a was added to the same amount as Dye I-14 and I-27 above and the total amount was made up to 1 liter. This gelatin-containing aqueous solution was coated on a polyethylene-coated paper support in an amount to give a dry film thickness of 4 μm. Further, 500 ml of a 0.05 wt% methanol solution cf Dye-7 indicated below was added to 1 kg of an emulsion of silver chloroiodobromide (bromide content 30 mol%, iodide content 0.1 mol%, average silver halide diameter 0.30 microns) that had been chemically sensitized with gold and sulfur compounds and to this was added 30 ml of a 1.0 wt% methanol solution of Cpd-12, 20 ml of a 0.5 wt% solution of Cpd-13, 40 ml of a 0.6 wt% solution of Cpd-14, 30 ml of a 4.0 wt% aqueous solution of sodium dodecylbenzene-sulfonate and 35 ml of a 1.0 wt% aqueous solution of 1-hydroxy-3,5-dichlorotriazine sodium salt. This was stirred and coated on the gelatin coating side of the above-noted support. Then, an aqueous solution containing gelatin and sodium dodecylbenzenesulfonate was coated on top of this as protective layer.

The films thus produced were exposed using (A) 760 nm light-emitting diode light and (B) 783 nm semiconductor laser light and processed for 20 seconds at 38° C. using LD-385 developing solution manufactured by Fuji Photo Film, Company, Ltd. in an FG-800RA automatic developing machine (manufactured by the Fuji Photo Film Co., Ltd.).

Image quality was evaluated in five stages going from 1 (very poor image quality with much fringing) to 5 (no fringing, sharp image). Residual color was evaluated in five stages going from 1 (large amount of residual color) to 5 (no residual color at all). It is noted that fringing and residual color can be evaluated with greater sensitivity by visual examination than they can by measurements by instruments and in actual use of photographic materials they are evaluated by visual examination.

The results are shown in Table 4.

TABLE 4

| Sample No. | Dye No. | Image Quality A | Image Quality B | Residual color After Dispersion |
|---|---|---|---|---|
| 1 (Comparison Example) | No dye | 1 | 1 | 5 |
| 2 (Invention) | Dispersion A | 4 | 5 | 4 |
| 3 (Invention) | Dispersion A | 4 | 5 | 4 |
| 4 (Comparison Example) | Comparison dye a | 3 | 4 | 2 |

Comparison Dye a is the following dye that is disclosed in U.K. Patent 434,875.

Dye-7

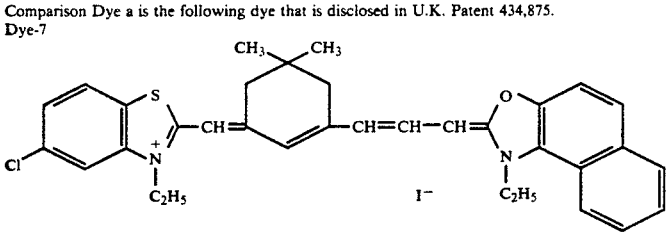

Cpd-14

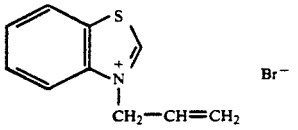

Comparison dye a

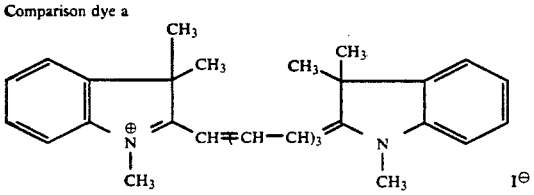

As is seen from the results in Table 1, good quality images with little residual color can be produced when dispersions of the invention are used.

EXAMPLE 4

2 kg of an aqueous solution containing 1 kg of silver nitrate and 2 kg of an aqueous solution containing 70 g of potassium bromide and 359 g of sodium chloride were added simultaneously and at a constant rate over a 30 minute period to an aqueous solution containing 75 g of gelatin. Next, after removal of soluble salts, gelatin was added and the materials were chemically ripened, so giving a silver chlorobromide emulsion (grain size 0.30 μm, Br 10 mol%).

To this emulsion was further added $4\times10^{-5}$ mol of the sensitizing dye, Dye 6, indicated below, $2\times10^{-4}$ mol of Cpd-12 noted in Example 1 and $5\times10^{-4}$ mol of Cpd-13 relative to 1 mole of silver halide, and then 1-hydroxy-3,5-dichlorotriazine sodium salt was as a hardener and sodium dodecylbenzenesulfonate was added as a coating assistant. This emulsion was coated on a polyethylene terephthalate film to an amount to give 4 g of silver per 1 $m^2$.

Crystals of a dye with the composition shown below were milled and ground to micrograins (with an average diameter of 0.15 μm or less) by a sand mill. Next, they were dispersed in 25 ml of a 10% lime-treated gelatin aqueous solution in which 0.1 g of citric acid was dissolved, the sand that had been used was removed by means of a glass filter. Dye that was adsorbed by the sand on the glass filter was washed off with hot water, so producing 100 ml of a 7% gelatin aqueous solution.

Dispersion D

| | |
|---|---|
| Dye I-3 | 1.5 g |
| 5% Aqueous Solution of Surfactant | 5 ml |

-continued

| Dispersion D |
|---|
| (Cpd-11) |

To a gelatin aqueous solution containing the solid dye micrograin dispersion thus produced was added polymethyl methacrylate as a matting agent and sodium dodecylbenzenesulfonate as an auxiliary solvent and thus coated as a protective layer on the layer containing the above-described silver halide emulsion. (Sample 1).

For comparison, a sample was produced by coating a protective layer which was prepared in exactly the same way except that it did not contain the above-noted dye. (Sample 2).

A safelight safety test was conducted in the form of 50 minutes illumination of the samples thus prepared with light from a tungsten lamp that was passed through a No. 4 LD safelight filter manufactured by Fuji Photo Film Company, Ltd. The development processing in the test consisted of 20 seconds at 38° C. using LD-835 manufactured by Fuji Photo Film Co. Ltd. The resulting fogging values are shown in Table 5.

Dye-6

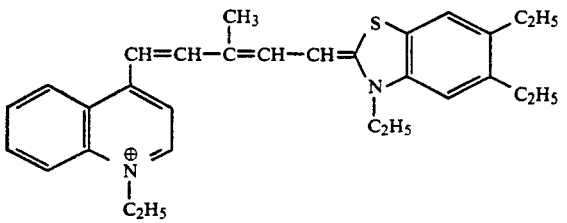

TABLE 5

| | Fogging Value | |
|---|---|---|
| | Without Safelight Illumination | After Safelight Illumination |
| Sample 1 (Invention) | 0.05 | 0.06 |
| Sample 2 (Comparison) | 0.05 | 0.10 |

With the sample material of the invention, there was little increase of fogging following safelight illumination, and further there was no residual color after development processing.

EXAMPLE 5

Photographic Materials 5-1 to 5-6 were prepared by coating microcrystal dispersions produced in the same way as described in Example 4, together with an emulsion layer and a surface protective layer whose details are given below, on both sides of a subbed 175 μm polyethylene terephthalate film that had been dyed blue.

| Content of Dye Layer - on each side | |
|---|---|
| Gelatin | 0.12 g/m$^2$ |
| Dye Microcrystal Dispersion | as indicated in Table 6 |

DETAILS OF EMULSION LAYER COATING SOLUTION PREPARATION OF EMULSION LAYER COATING SOLUTION 5 g of potassium bromide, 0.05 g of potassium iodide, 30 g of gelatin and 2.5 cc of a 5% aqueous solution of the thioether $HO(CH_2)_2S(CH_2)_2S(CH_2)_2OH$ were added to 1 liter of water and, while the solution was held at 75° C. and stirred, an aqueous solution of 8.33 g of silver nitrate and an aqueous solution containing 5.94 g of potassium bromide and 0.726 g of potassium iodide were added over a 45 second period using the double jet method. Then, after addition of 2.5 g of potassium bromide, an aqueous solution containing 8.33 g of silver nitrate was added over 7 minutes 30 seconds in a manner such that the flow rate at the end of the addition was double that at the start. Next, an aqueous solution of 153.34 g of silver nitrate and an aqueous solution of potassium bromide were added by the controlled double jet method over a period of 25 minutes while the potential was controlled in a manner so as to maintain the pAg at 8.1. The flow rare this time was accelerated in a manner such that the flow rate at the end of the addition was 8 times that at the start. After completion of the addition, 15 cc of a 2 N potassium thiocyanate solution was added and a further addition, taking 30 seconds, of 50 cc of a 1% potassium iodide aqueous solution was made. After this, the temperature was lowered to 35° C. and after removal of soluble salts by precipitation process, the temperature was raised to 40° C., 68 g of gelatin, 2 g phenol and 7.5 g of trimethylolpropane were added and the pH was adjusted to 6.55 and the pAg to 8.10 using sodium hydroxide and potassium bromide.

After raising the temperature to 56° C., 735 mg of a sensitizing dye with the structure indicated below was added. After 10 minutes, 5.5 mg of sodium thiosulfate pentahydrate, 163 mg of potassium thiocyanate and 3.6 mg of chloroauric acid were added and 5 minutes later the material was cooled rapidly and solidified. The emulsion produced was one in which 93% of the total projected area of all the grains was represented by grains with an aspect ratio of 3 or more and in which values in respect of all the grains which had an aspect ratio of 2 or more were an average projected area diameter of 0.85 μm, a standard deviation of 18.5%, a thickness average of 0.161 μm and an aspect ratio of 5.16.

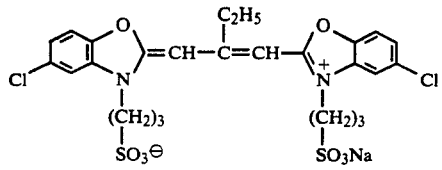

A coating solution was produced by adding the following materials to this emulsion per 1 mole of silver halide.

| | |
|---|---|
| 2,6-Bis(hydroxyamino)-4-diethylamino-1,3,5-triazine | 94.5 mg |
| Sodium Polyacrylate (average molecular weight 41,000) | 2.7 g |
| 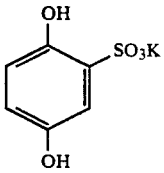 | 10.0 g |
| Copolymer Plasticizer (compositional ratios ethyl acrylate/acrylic acid/methacrylic acid = 95/2/3) | 24.8 g |
| Potassium Bromide | 77 mg |

-continued

| | |
|---|---|
| Emulsion Layer Coating Quantities | |
| Amount of Coated Silver | 1.7 g/m$^2$ |
| Amount of Coated Gelatin | 1.7 g/m$^2$ |
| Polyacrylamide (average molecular weight 45,000) on each side. | 0.47 g/m$^2$ |

CONTENT OF SURFACE PROTECTION LAYER

The Surface protective layer coating quantities comprised the following quantities on each side.

| | |
|---|---|
| Gelatin | 1.4 g/m$^2$ |
| Polyacrylamide (average molecular weight 45,000) | 0.23 g/m$^2$ |
| Matt Agent (average grain diameter 3.5 μm) | 0.05 g/m$^2$ |
| Polymethyl Methacrylate/Methacrylic Acid = 9:1 copolymer | |
| 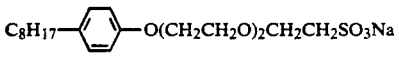 | 22.5 g/m$^2$ |
| $C_{16}H_{33}O(CH_2CH_2O)_{10}H$ | 20 g/m$^2$ |
| $C_8H_{17}SO_2N(C_3H_7)(CH_2CH_2O)_{15}H$ | 5 mg/m$^2$ |
| $C_8H_{17}SO_2N(C_3H_7)(CH_2CH_2O)_4(CH_2)_4SO_3Na$ | 1 mg/m$^2$ |
| 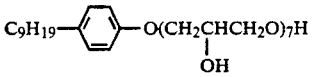 | 10 g/m$^2$ |
| 4-Hydroxy-6-methyl-1,3,3a,7-tetra-azaindene | 21.7 mg/m$^2$ |

1,2-bis(Sulfonylacetamido)ethane was added as a hardener to amounts to give 57 mg/m$^2$ on each side.

EVALUATION OF PHOTOGRAPHIC PERFORMANCE

G-4 screens of Fuji Photo Film Co., Ltd. GRENEX series were used as screens in exposure of Photographic Materials 5-1 to 5-6. Each of Photographic Materials 5-1 to 5-6 was sandwiched between and held in close contact with two G-4 screens, as in normal procedure, and X ray exposure was effected via 10 cm of a water phantom.

The post-exposure processing comprised automatic development unit processing at 35° C. using RD-III manufactured by Fuji Photo Film Co., Ltd. as the developing solution and with Fuji FIX manufactured by Fuji Photo Film Co., Ltd. used as the fixing solution in an FPM-4000 unit also manufactured by Fuji Photo Film Co., Ltd.

Speed was expressed as relative speed taking the speed of Photographic Material 5-1 to be 100.

SHARPNESS (MTF) MEASUREMENTS

Measurements were made of MTF values with a combination of use of the above-noted G-4 screens and automatic development unit processing. Measurements were made with an aperture of 30 μm×500 μm and evaluations were made in portions in which the optical density was 1.0 when the MTF value had a spatial frequency of 1.0 cycles/mm.

EVALUATION OF RESIDUAL COLOR

In addition, unexposed film of the above-noted photographic materials was subjected to the processing described above and used in functional evaluation of the residual color level.

The standards employed were

A ... state in which it is practically impossible to detect the existence of residual color C ... state in which one is aware of the existence of residual color but the level presents no particular worry for practical purposes E ... state in which residual color is clearly present and this is a concern from a practical technical point of view with B and D representing intermediate states.

The results of the above evaluations are given together with details of the samples in Table 6 below.

TABLE 6

| Photographic Material | Microcrystal Dispersion: Dye | Content (mg/m$^2$) (per side) | Relative Speed | MTF | Residual Color |
|---|---|---|---|---|---|
| 5-1 (Comparison Example) | — | — | 100 | 0.74 | A |
| 5-2 (Comparison Example) | Comparison Compound 1 | 80 | 81 | 0.77 | D |
| 5-3 (Comparison Example) | Comparison Compound 2 | 80 | 77 | 0.78 | C |
| 5-4 (Invention) | Compound 1 of the Invention | 50 | 90 | 0.82 | B |
| 5-5 (Invention | Compound 1 of the Invention | 100 | 87 | 0.84 | B |
| 5-6 (Invention) | Compound 4 of the Invention | 50 | 89 | 0.81 | B |

It is seen from the results in that Photographic Materials 5-4to 5-6 of the invention are superior in respect of relative speed, sharpness (MTF) and residual color balance.

Comparison Compound 1

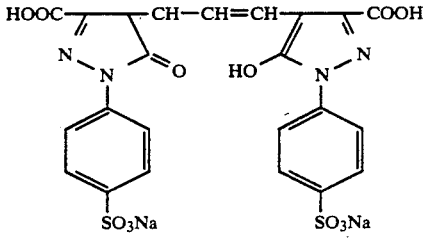

Comparison Compound 2
C. I. Acid Violet 19 (C. I. 42,685)

EXAMPLE 5

Following corona discharge treatment of the support, gelatin subbing layers and the dye dispersion noted below were used on paper supports laminated on both sides with polyethylene to give paper support Samples A, B and C.

DYE DISPERSION PROCEDURE

Crystals of a dye with the composition noted below were milled and micrograins were formed by a sand mill. Then, they were dispersed in 25 ml of a 10% limet-reated gelatin aqueous solution in which 0.5 g of citric acid was dissolved, the sand that had been used was removed by means of a glass filter, dye that was adsorbed by the sand or the glass filter was removed and 100 ml of a 7% gelatin aqueous solution was added. (The average grain diameter of the dye micrograins was 0.15 μm.)

| | |
|---|---|
| Compound 1 of the Invention | 1.0 g |
| Compound 3 of the Invention | 1.6 g |
| 5% Aqueous Solution of | 5 ml |

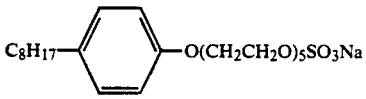

(surfactant)

| | |
|---|---|
| Paper Support A: Subbing Layer | |
| Gelatin | 0.8 g/m² |
| Paper Support B: Antihalation Layer | |
| Gelatin | 0.6 g/m² |
| Compound 1 of the Invention | 25 mg/m² |
| Compound 3 of the Invention | 40 mg/m² |
| Paper Support C: Antihalation Layer | |
| Gelatin | 0.6 g/m² |
| Compound 1 of the Invention | 40 mg/m² |
| Compound 3 of the Invention | 65 mg/m² |

Multilayer color printing paper Samples 4-1 to 4—4 with the layer structures noted below were produced on Paper Supports A, B and C.

The coating solutions were prepared as follows.

PREPARATION OF FIRST LAYER COATING SOLUTION 19.1 g of a yellow coupler (ExY0), 4.4 g of a color image stabilizer (Cpd-1) and 1.8 g of a color stabilizer (Cpd-7) were dissolved by addition of 27.2 cc of ethyl acetate, 4.1 g of a solvent (Solv-3) and 4.1 g of a solvent (Solv-6) and the resulting solution was emulsified and dispersed in 185 cc of a 10% gelatin aqueous solution containing 8 cc of 10% sodium dodecylbenzene sulfonate. A material in which the blue-sensitive sensitizing dye indicated below was added to a sulfur-sensitized silver chlorobromide emulsion (mixture in the ratio 1:3 (Ag molar ratio) of material with 80.0 mol%, cubic grains, an average grain size of 0.85 μ and a variation coefficient of 0.08 and material with 80.0 mol% of silver bromide, cubic grains, an average grain size of 0.62 μ and a variation coefficient of 0.07) in an amount that was $5.0\times10^{-4}$ moles per 1 mole of silver was also prepared. The First Layer coating solution was prepared by mixing and dissolving this emulsion and the emulsified dispersion described above with the composition given below. The Second Layer to Seventh Layer coating solutions were prepared in the same way as the First Layer coating solution. 1-Oxy-3,5-dichloro-s-triazine sodium salt was used as a gelatin hardening agent in each layer.

The following compounds were used as sensitizing dyes in the various layers.

Blue-Sensitive Emulsion Layer

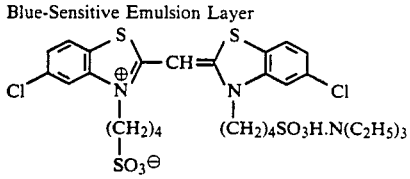

($5.0\times10^{-4}$ mol per 1 mole of silver halide)

Green-Sensitive Emulsion Layer

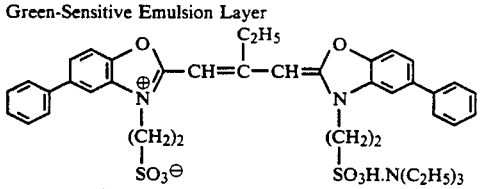

($4.0\times10^{-4}$ mol per 1 mole of silver halide)

and

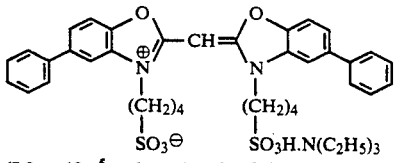

($7.0\times10^{-5}$ mol per 1 mole of silver halide)

Red-Sensitive Emulsion Layer

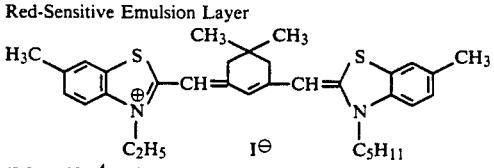

($0.9\times10^{-4}$ mol per 1 mol of silver halide)

$2.6\times10^{-3}$ mol of the following compound were added to the red-sensitive emulsion layer per 1 mol of silver halide.

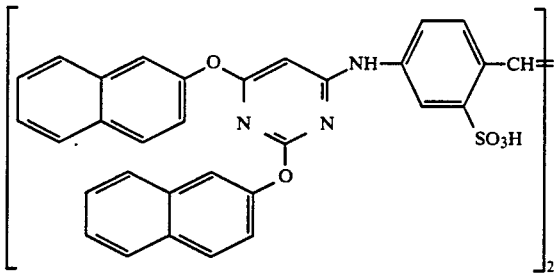

Also, to the blue-sensitive emulsion layer, green-sensitive emulsion layer and red-sensitive emulsion layer were added $4.0\times10^{-6}$ mol, $3.0\times10^{-5}$ mol and $1.0\times10^{-5}$ mol of 1-(5-methylureidophenyl)-5-mercaptotetrazole and $8\times10^{-3}$, $2\times10^{-2}$ and $2\times10^{-2}$ mol of 2-methyl-5-t-octylhydroquinone per 1 mol of silver halide.

To the blue-sensitive emulsion layer and the green-sensitive emulsion layer were further added, respectively, $1.2\times10^{-2}$ and $1.1\times10^{-2}$ mol of 4-hydroxy-6-methyl-1,3,3*a*,7-tetra-azaindene per 1 mol of silver halide.

The following comparison dyes were added to the emulsion layers on one of the paper support Samples A.

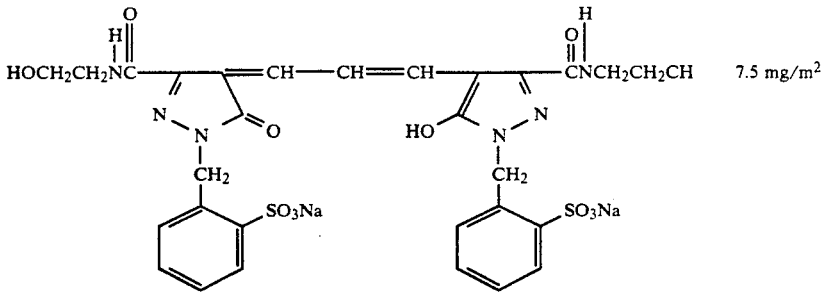

and

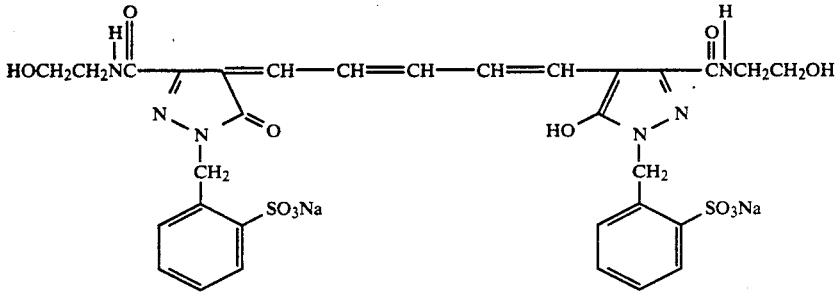

LAYER STRUCTURES

The compositions of the various layers were as follows. The figures indicate coating quantities (g/m$^2$). Values for silver halide emulsions are given as values converted to amount of coated silver.

SUPPORTS

Four types of Samples A, B and C with subbing layers and antihalation layers provided on polyethylene-laminated paper (with white pigment ($TiO_2$) and blue eye (ultramarine) included in polyethylene on the First Layer side)

| | |
|---|---|
| First Layer (blue-sensitive layer) | |
| Silver Chlorobromide Emulsion described above (AgBr: 80 mol %) | 0.26 |
| Gelatin | 1.83 |
| Yellow Coupler (ExY) | 0.83 |
| Color Image stabilizer (Cpd-1) | 0.19 |
| Color Image stabilizer (Cpd-7) | 0.08 |
| Solvent (Solv-3) | 0.18 |
| Solvent (Solv-6) | 0.18 |
| Second Layer (color mixing preventing layer) | |
| Gelatin | 0.99 |
| Color Mixing Preventing Agent (Cpd-6) | 0.08 |
| Solvent (Solv-1) | 0.16 |
| Solvent (Solv-4) | 0.08 |
| Third Layer (green-sensitive layer) | |
| Silver Chlorobromide Emulsion (mixture in the ratio 1:1 (Ag molar ratio) of material with 90 mol % AgBr, cubic grains, average grain size of 0.47μ and variation coefficient of 0.12 and material with 90 mol % AgBr, cubic grains, average grain size of 0.36μ and variation coefficient of 0.09) | 0.16 |
| Gelatin | 1.79 |
| Magenta Coupler (ExM) | 0.32 |
| Color Image Stabilizer (Cpd-3) | 0.20 |
| Color Image Stabilizer (Cpd-8) | 0.03 |
| Color Image Stabilizer (Cpd-4) | 0.01 |
| Color Image Stabilizer (Cpd-9) | 0.04 |
| Solvent (Solv-2) | 0.65 |
| Fourth Layer (ultraviolet ray absorption layer) | |
| Gelatin | 1.58 |
| Ultraviolet Light Absorber (UV-1) | 0.47 |
| Color Mixing Preventing Agent (Cpd-5) | 0.05 |
| Solvent (Solv-5) | 0.24 |
| Fifth Layer (red-sensitive layer) | |
| Silver Chlorobromide Emulsion (mixture in the ratio 1:2 (Ag molar ratio) of material with 70 mol % AgBr, cubic grains, average grain size of 0.49μ and variation coefficient of 0.08 and material with 70 mol % AgBr, cubic grains, average grain size of 0.34μ and variation coefficient of 0.10) | 0.23 |
| Gelatin | 1.34 |
| Cyan Coupler (ExC) | 0.30 |
| Color Image Stabilizer (Cpd-6) | 0.17 |
| Color Image Stabilizer (Cpd-7) | 0.40 |
| Solvent (Solv-6) | 0.20 |

-continued

| | |
|---|---|
| Sixth Layer (ultraviolet light absorption layer) | |
| Gelatin | 0.53 |
| Ultraviolet Light Absorber (UV-1) | 0.16 |
| Color Mixing Preventing Agent (Cpd-5) | 0.02 |
| Solvent (Solv-5) | 0.08 |
| Seventh Layer (protective layer) | |
| Gelatin | 1.33 |
| Polyvinyl Alcohol acryl-modified copolymer (modification degree 17%) | 0.17 |
| Liquid Paraffin | 0.03 |

(Cpd-1) Color Image Stabilizer

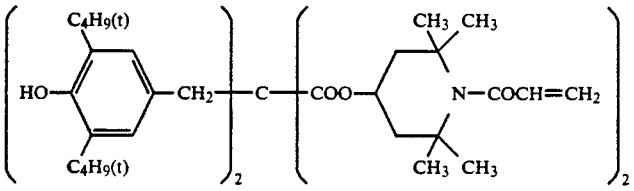

(Cpd-3) Color Image Stabilizer

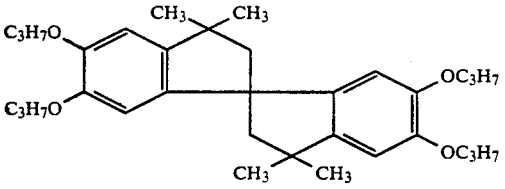

(Cpd-4) Color Image Stabilizer

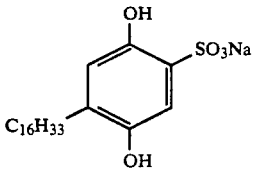

(Cpd-5) Color Mixing Preventing Agent

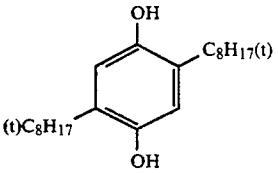

(Cpd-6) Color Stabilizer
2:4:4 mixture (weight ratio) of

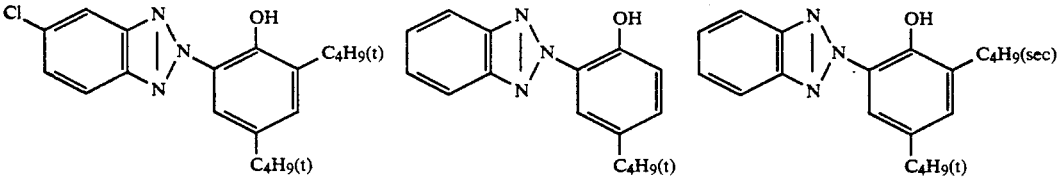

(Cpd-7) Color Image Stabilizer

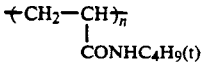

molecular weight 80,000

(Cpd-8) Color Image Stabilizer

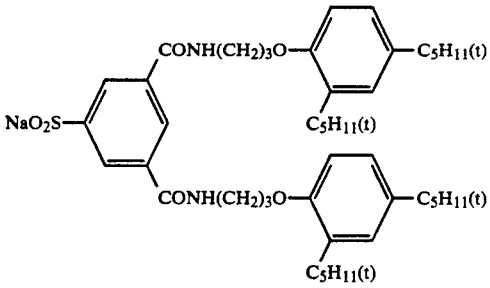

(Cpd-9) Color Image Stabilizer

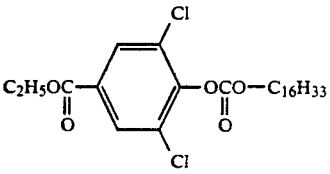

(UV-1) Ultraviolet Light Absorbent
4:2:4 mixture (weight ratio) of

-continued

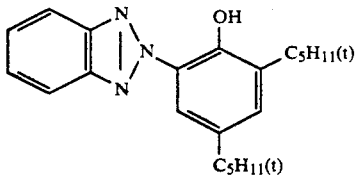

(Solv-1) Solvent

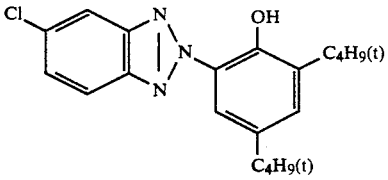

(Solv-2) Solvent

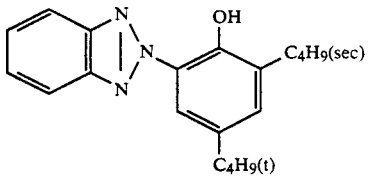

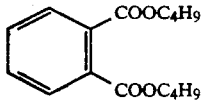

(Solv-3) Solvent
$O{=}P{+}O{-}C_9H_{19}(iso))_3$

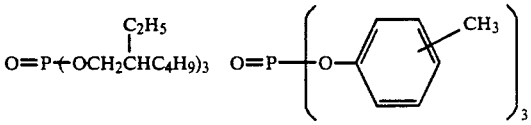

(Solv-4) Solvent

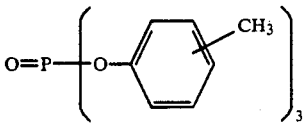

(Solv-5) Solvent
$COOC_8H_{17}$
$(CH_2)_8$
$COOC_8H_{17}$ (Solv-6) Solvent
$C_8H_{17}CHCH(CH_2)_7COOC_8H_{17}$
O (ExY) Yellow Coupler

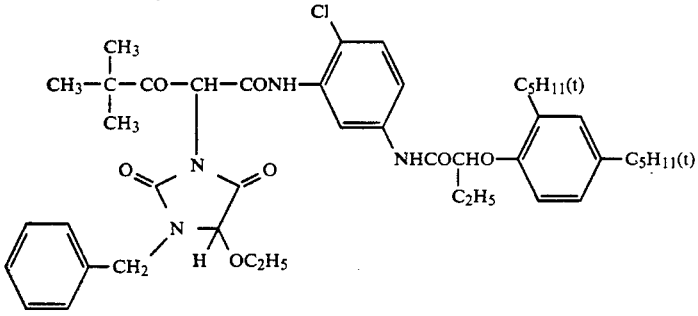

(ExM) Magenta Coupler

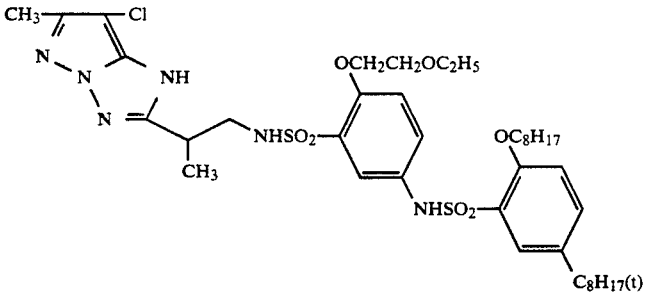

(ExC) Cyan Coupler
1:1 mixture (molar ratio) of

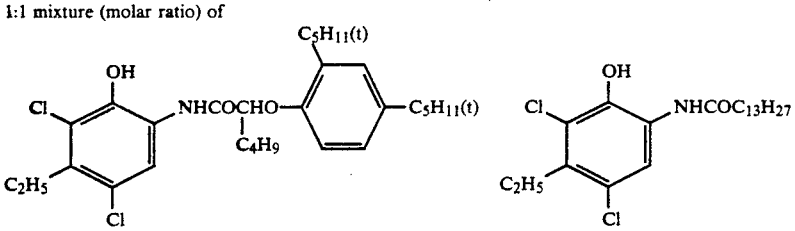

The resulting Samples 6-1 to 6-4 were subjected to gradated exposure for sensitometry via blue, green and red filters, using a photosensitometer (manufactured by Fuji Photo Film Co., Ltd, FWH model, light source color temperature 3,200° K). They were also subjected to exposure for the purpose of resolving power (CTF) measurements and subsequently were subjected to the development processing indicated below. Density measurements were made on the resulting samples, giving the results noted in Table 7 below.

TABLE 7

| Sampl No. | Support Used (dye used) | Relative Speed Cyan | Relative Speed Magenta | Dmin* Cyan | Dmin* Magenta | Resolving Power lines/mm (CTF 50%) Cyan | Magenta | Yello |
|---|---|---|---|---|---|---|---|---|
| 6-1 | A (none used) | 100 | 100 | 0.02 | 0.02 | 7 | 11 | 8 |
| 6-2 | A (comparison dye) | 58 | 67 | 0.02 | 0.02 | 10 | 14 | 11 |
| 6-3 | B (Compound 1 of the Invention Compound 3 of the Invention) | 84 | 82 | 0.02 | 0.02 | 13 | 15 | 12 |
| 6-4 | C (Compound 1 of the Invention Compound 3 of the Invention) | 72 | 68 | 0.03 | 0.03 | 15 | 19 | 15 |

Dmin* represents (Dmin (minimum density) - reflection density of support).

When dyes according to the invention are used in antihalation layers, there is comparatively little reduction of speed and residual color is not conspicuous. Use in amounts of this order make possible a marked improvements in the resolving power.

| Processing Steps | Processing Steps Temperature | Time |
|---|---|---|
| Color Development | 37° C. | 3 minutes 30 seconds |
| Bleach-Fixing | 33° C. | 1 minute 30 seconds |
| Washing | 24 to 34° C. | 3 minutes |
| Drying | 70 to 80° C. | 1 minute |
| **Processing Solutions** | | |
| Color Development Solution | | |
| Water | | 800 ml |
| Diethylenetriaminepentaacetic Acid | | 1.0 g |
| Nitrilotriacetic Acid | | 2.0 g |
| 1-Hydroxyethylidene-1,1-diphosphonic Acid (60% Aq. solution) | | 1.0 ml |
| Benzyl Alcohol | | 15 ml |
| Diethylene Glycol | | 10 ml |
| Sodium Sulfite | | 2.0 g |
| Potassium Bromide | | 1.0 g |
| Potassium Carbonate | | 30 g |
| N-Ethyl-N-(β-methanesulfonamidoethyl)-3-methyl-4-aminoaniline Sulfate | | 4.5 g |
| Hydroxylamine Sulfate | | 3.0 g |
| Fluorescent Brightening Agent (WHITEX 4, manufactured by Sumitomo Chemical Co., Ltd.) | | 1.0 g |
| Water to make | | 1000 ml |
| pH (25° C.) | | 10.25 |
| Bleach-Fixing Solution | | |
| Water | | 400 ml |
| Ammonium Thiosulfate (70% Aq. Soln.) | | 150 ml |
| Sodium Sulfite | | 18 g |
| Iron (III) Ammonium Ethylenediamine tetraacetate | | 50 g |
| Disodium Ethylenediaminetetraacetate | | 5 g |
| Water added | | 1000 ml |
| pH (25° C.) | | 6.70 |

Similar results are obtained with color printing paper permitting rapid development that is produced by providing high silver chloride emulsions on support Samples B and C (and has multilayer structures such as described in European Patents 273,429 and 273,430).

While the invention has been described in detail and with reference to specific embodiments thereof, it will be apparent to specific embodiments thereof, it will be apparent to one skilled in the art that various changes and modifications can be made therein without departing from the spirit and scope thereof.

What is claimed is:

1. A photosensitive silver halide photographic element comprising a support having thereon a silver halide emulsion layer and at least one hydrophilic colloid layer containing a solid micrograin dispersion of a compound represented by the following general formula (I) in an amount from 1 to 1000 mg per 1 $m^2$ of the photographic element surface area:

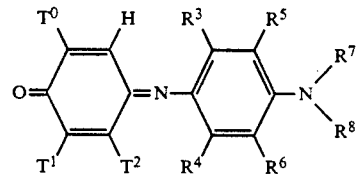

(I)

wherein, $T^0$ represents a group having a structure according to formula (i):

$$-CO-NHG^1 \quad \text{(i)}$$

wherein $G^1$ represents a substituted or unsubstituted alkyl group, a substituted or unsubstituted aryl group, or a substituted or unsubstituted heterocyclic group; $T^1$ and $T^2$ each independently represents a hydrogen atom, a halogen atom or a cyano, nitro, carboxy, alkyl, aryl, alkoxy, aryloxy, alkylthio, arylthio, alkylsulfonyl, arylsulfonyl, sulfamoyl, carbamoyl, amino, sulfonamido, carbonamido, ureido, sulfamoylamino, hydroxyl, alkenyl or acyl group, $R^3$ and $R^4$ each independently represents a hydrogen atom, a halogen atom or an alkoxy, alkyl, alkenyl, aryloxy or aryl group, $R^5$ and $R^6$ each independently represents a hydrogen atom or a group in which hydrogen atom substitution is possible, and $R^7$ and $R^8$ each independently represents an alkyl, aryl, vinyl, acyl or alkyl- or arylsulfonyl group, provided that rings may be formed by linkage of $T^1$ with $T^2$, $R^3$ with $R^5$, $R^4$ with $R^6$, $R^7$ with $R^8$, $R^5$ with $R^7$ and $R^6$ with $R^8$; wherein the silver halide emulsion layer and the at least one hydrophilic colloid layer may be the same or different; and wherein the micrograins of the dispersion have an average diameter of 10 microns or less.

2. The silver halide photographic element of claim 1, wherein the 1 to 4 substituents of the solid micrograin dispersion compound have an acid dissociation constant pKa in the range of 4 to 11.

3. The silver halide photographic element of claim 1, wherein the solid micrograin dispersion compound has the following formula (Ia):

(Ia)

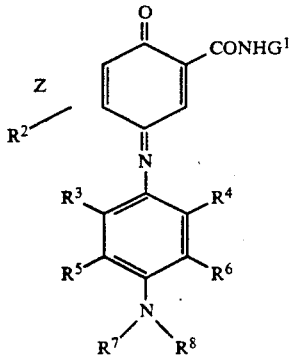

wherein G [1], $R^3$, $R^4$, $R^5$, $R^6$, $R^7$, and $R^8$, are as previously defined, Z represents a benzene ring or an atomic group needed for forming a 5 or 6 member hereto-ring, and $R^2$ represents a group selected from the groups as defined for $R^5$ and $R^6$.

4. The silver halide photographic element of claim 1, which also contains tabular emulsion grains with an average aspect ratio of 5 or more.

5. A photosensitive silver halide photographic element comprising a support having thereon a silver halide emulsion layer and at least one hydrophilic colloid layer containing a solid micrograin dispersion of a compound represented by the following general formula (I) in an amount from 1 to 1000 mg per 1 $m^2$ of the photographic element surface area:

(I)

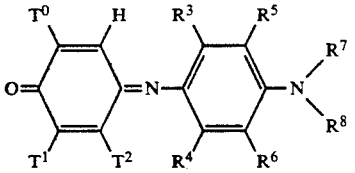

wherein, $T^0$ represents a group having a structure according to formula (ii):

$$-SO_2-NG^2G^3 \quad \text{(ii)}$$

wherein $G^2$ represents a substituted or unsubstituted alkyl group, a substituted or unsubstituted aryl group, or a substituted or unsubstituted heterocyclic group, and wherein $G^3$ represents a substituted or unsubstituted alkyl group, a substituted or unsubsituted aryl group, or a substituted or unsubstituted heterocyclic group, $T^1$ and $T^2$ each independently represents a hydrogen atom, a halogen atom or a cyano, nitro, carboxy, alkyl, aryl, alkoxy, aryloxy, alkylthio, arylthio, alkylsulfonyl, arylsulfonyl, sulfamoyl, carbamoyl, amino, sulfonamido, carbonamido, ureido, sulfamoylamino, hydroxyl, alkenyl or acyl group, $R^3$ and $R^4$ each independently represents a hydrogen atom, a halogen atom or an alkoxy, alkyl, alkenyl, aryloxy or aryl group, $R^5$ and $R^6$ each independently represents a hydrogen atom or a group in which hydrogen atom substitution is possible, and $R^7$ and $R^8$ each independently represents an alkyl, aryl, vinyl, acyl or alkyl- or arylsulfonyl group, provided that rings may be formed by linkage of $T^1$ with $T^2$, $R^3$ with $R^5$, $R^4$ with $R^6$, $R^7$ with $R^8$, $R^5$ with $R^7$ and $R^6$ with $R^8$; wherein the silver halide emulsion layer and the at least one hydrophilic colloid layer may be the same or different; and wherein the micrograins of the dispersion have an average diameter of 10 microns or less.

6. The silver halide photographic element of claim 5, wherein the solid micrograin dispersion compounds have the following formula (Ib):

(Ib)

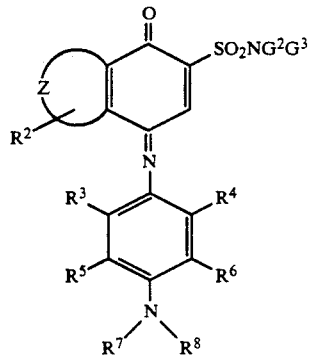

wherein $G^2$, $G^3$, $R^3$, $R^4$, $R^5$, $R^6$, $R^7$, and $R^8$ are as previously definded, Z represents a benzene ring or an atomic group needed for forming a 5 or 6 member heteroring, and $R^2$ represents a group selected from the groups as defined for $R^5$ and $R^6$.

7. The silver halide photographic element of claim 5, wherein the 1 to 4 substituents of the solid micrograin dispersion compound have an acid dissociation constant pKa in the range of 4 to 11.

8. The silver halide photographic element of claim 5, wherein the solid micrograin dispersion compound has the following formula (Ib):

(Ib)

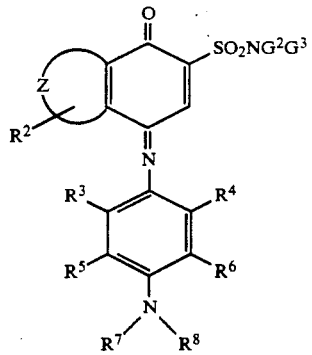

wherein $G^2$, $G^3$, $R^3$, $R^4$, $R^5$, $R^6$, $R^7$, and $R^8$ are as previously defined, Z represents a benzene ring or an atomic group needed for forming a 5 or 6 member hetero-ring, and $R^2$ represents a group selected from the groups as defined for $R^5$ and $R^6$.

9. The silver halide photographic element of claim 5, which also contains tabular emulsion grains with an average aspect ratio of 5 or more.

10. The silver halide photographic element of claim 8, wherein $G^2$ represents a heterocyclic group or represents a group which is substituted by groups having a Hammet substituent constant of $o_m$ or $o_p$ that is greater than 0.23.

* * * * *